US011827028B2

(12) United States Patent
Miyagishi

(10) Patent No.: US 11,827,028 B2
(45) Date of Patent: Nov. 28, 2023

(54) LIQUID DISCHARGING APPARATUS AND LIQUID FILLING METHOD

(71) Applicant: SEIKO EPSON CORPORATION, Tokyo (JP)

(72) Inventor: Akira Miyagishi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 184 days.

(21) Appl. No.: 17/304,428

(22) Filed: Jun. 21, 2021

(65) Prior Publication Data

US 2021/0394522 A1 Dec. 23, 2021

(30) Foreign Application Priority Data

Jun. 23, 2020 (JP) ..... 2020-107503

(51) Int. Cl.
*B41J 2/175* (2006.01)
*B41J 2/14* (2006.01)

(52) U.S. Cl.
CPC ..... *B41J 2/17566* (2013.01); *B41J 2/14* (2013.01)

(58) Field of Classification Search
CPC ..... B41J 2/04596; B41J 2/14; B41J 2/04581; B41J 2/175; B41J 2/14233; B41J 2/04593; B41J 2/18; B41J 2/17566; B41J 29/38; B41J 2002/14241; B41J 2202/12
See application file for complete search history.

(56) References Cited

U.S. PATENT DOCUMENTS

| | | | | |
|---|---|---|---|---|
| 10,703,098 | B2 * | 7/2020 | Okazawa | B41J 2/04588 |
| 10,843,479 | B2 * | 11/2020 | Takahashi | B41J 2/17566 |
| 10,913,267 | B2 * | 2/2021 | Kaneko | B41J 2/04553 |
| 11,230,115 | B2 * | 1/2022 | Shinoda | B41J 2/175 |
| 2019/0009563 | A1 | 1/2019 | Tokisawa et al. | |

FOREIGN PATENT DOCUMENTS

JP 2019-014253 A 1/2019

* cited by examiner

*Primary Examiner* — An H Do
(74) *Attorney, Agent, or Firm* — WORKMAN NYDEGGER

(57) ABSTRACT

A liquid discharging apparatus has: a liquid discharging head that has a driving element and a pressure chamber in which liquid is pressurized when the driving element is driven; a driving circuit that drives the driving element; a detection circuit that detects a signal related to residual vibration in the pressure chamber; and a control section that controls a filling operation to supply liquid from the outside into the liquid discharging head. The control section terminates the filling operation according to a signal detected by the detection circuit after the driving element is driven by the driving circuit.

16 Claims, 17 Drawing Sheets

FIG. 8

| Sd[m] | D[m] | Qa[m] | | Qb[m] | | | Qs[m] | | |
|---|---|---|---|---|---|---|---|---|---|
| | | TQ1 | TQ2 | TT1 | TT2 | TT3 | TT1 | TT2 | TT3 |
| 1 | DP-1 (LARGE DOT) | H | H | L | L | L | L | L | L |
| 2 | DP-2 (MEDIUM DOT) | H | L | L | L | L | L | L | L |
| 3 | DP-3 (SMALL DOT) | L | H | L | L | L | L | L | L |
| 4 | DP-B (NON-FORMING) | L | L | L | L | L | L | L | L |
| 5 | DS (ELIGIBLE FOR DECISION) | L | L | H | L | H | L | H | L |

LIQUID DISCHARGING APPARATUS AND LIQUID FILLING METHOD

The present application is based on, and claims priority from JP Application Serial Number 2020-107503, filed Jun. 23, 2020, the disclosure of which is hereby incorporated by reference herein in its entirety.

BACKGROUND

1. Technical Field

The present disclosure relates to a liquid discharging apparatus and a liquid filling method.

2. Related Art

In relation to a liquid discharging apparatus, a technology that initially fills a recording head with an ink by using a pump is disclosed in, for example, in JP-A-2019-14253.

In the technology described in JP-A-2019-14253, a wait is made for a predetermined time, starting from when the recording head starts to be filled with ink, after which the pump is stopped to complete the filling. However, a time taken until the filling of ink is completed may vary depending on various factors such as the type of liquid to be filled, temperature in the environment, and error in the performance of the pump. Even when a wait is made for a predetermined time, therefore, a discharge failure may occur due to an insufficient amount of filled liquid or liquid may be unnecessarily discharged because liquid is filled more than necessary.

SUMMARY

According to a first aspect of the present disclosure, a liquid discharging apparatus is provided. This liquid discharging apparatus has: a liquid discharging head that has a driving element and a pressure chamber in which liquid is pressurized when the driving element is driven; a driving circuit that drives the driving element; a detection circuit that detects a signal related to residual vibration in the pressure chamber; and a control section that controls a filling operation to supply liquid from the outside into the liquid discharging head. The control section terminates the filling operation according to a signal detected by the detection circuit after the driving element is driven by the driving circuit.

According to a second aspect of the present disclosure, a liquid discharging apparatus is provided. This liquid discharging apparatus has: a liquid discharging head that has a driving element and a pressure chamber in which liquid is pressurized when the driving element is driven; a driving circuit that drives the driving element; a detection circuit that detects a signal related to temperature in the pressure chamber; and a control section that controls a filling operation to supply liquid from the outside into the liquid discharging head. The control section terminates the filling operation according to a signal detected by the detection circuit after the driving element is driven by the driving circuit.

According to a third aspect of the present disclosure, a liquid filling method is provided, the method being executed by a liquid discharging apparatus that has: a liquid discharging head that has a driving element and a pressure chamber in which liquid is pressurized when the driving element is driven; a driving circuit that drives the driving element; and a detection circuit that detects a signal related to residual vibration in the pressure chamber. In this liquid filling method, after a filling operation to supply liquid from the outside into the liquid discharging head is started, the filling operation is terminated according to a signal detected by the detection circuit after the driving element is driven by the driving circuit.

According to a fourth aspect of the present disclosure, a liquid filling method is provided, the method being executed by a liquid discharging apparatus that has: a liquid discharging head that has a driving element and a pressure chamber in which liquid is pressurized when the driving element is driven; a driving circuit that drives the driving element; and a detection circuit that detects a signal related to temperature in the pressure chamber. In this liquid filling method, after a filling operation to supply liquid from the outside into the liquid discharging head is started, the filling operation is terminated according to a signal detected by the detection circuit after the driving element is driven by the driving circuit.

BRIEF DESCRIPTION OF THE DRAWINGS

FIG. 8 shows the relationship between individually specifying signals and coupling state specifying signals.

DESCRIPTION OF EXEMPLARY EMBODIMENTS

A. First Embodiment

Figure 1:
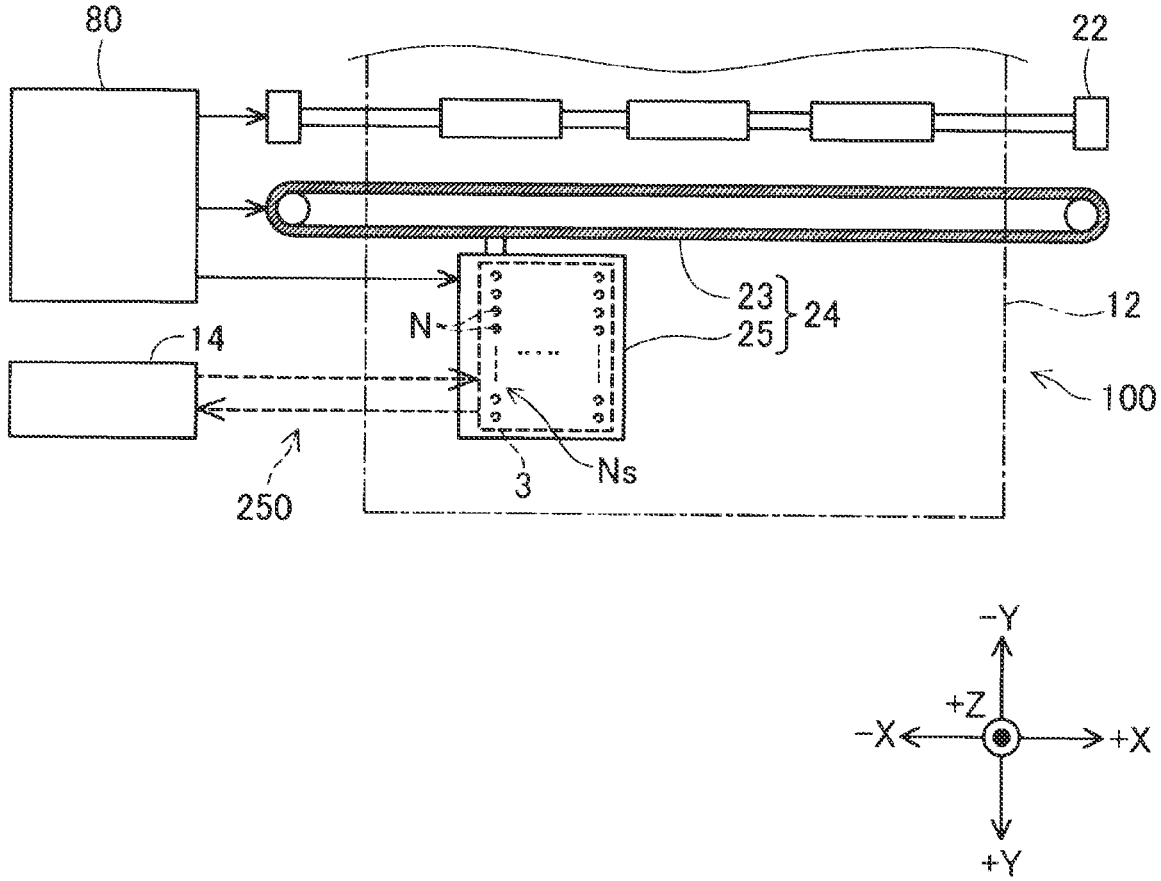
FIG. 1 schematically illustrates the structure of a liquid discharging apparatus in a first embodiment.

FIG. 1 schematically illustrates the structure of a liquid discharging apparatus 100 in a first embodiment. The liquid discharging apparatus 100 is an ink jet printing apparatus that performs printing by discharging liquid droplets of ink, which is an example of a liquid, to a medium 12. As the medium 12, not only printing paper but also a target eligible for printing that is made of a resin film, a cloth, or any other material can be used. In FIG. 1, the Y direction is a direction in which nozzles N in each nozzle row Ns, which will be described below, are aligned, the X direction is a direction in which nozzle rows Ns are arranged, and the Z direction is parallel to the vertical direction, the X, Y, and Z direction being mutually orthogonal. When an orientation needs to be identified, a symbol indicating a direction is prefixed with a positive sign + that indicates the positive direction or the negative sign − that indicates a negative direction. In this embodiment, the X direction is a main scanning direction, in which a liquid discharging head 32 moves; the Y direction a sub-scanning direction, in which a medium is fed, the sub-scanning direction being orthogonal to the main scanning direction; and the −Z direction is a direction in which ink is discharged. In drawings referenced later as well, arrows indicating relevant directions are illustrated so as to match FIG. 1.

The liquid discharging apparatus 100 has a liquid storage section 14, a transport mechanism 22 that feeds the medium 12, a control section 80, a head moving mechanism 24, and a head unit 3. The liquid storage section 14 individually stores a plurality of types of ink to be supplied to the head unit 3. As the liquid storage section 14, a bag-like pack formed from a flexible film, an ink tank in which ink can be replenished, a detachable ink cartridge, or the like can be used.

The control section 80 includes a processing circuit formed from, for example, one or a plurality of central processing units (CPUs) or field programmable gate arrays (FPGAs) and also includes a storage circuit such as a semiconductor memory. The control section 80 controls the entire operation of the liquid discharging apparatus 100. The control section 80 has a function for executing printing processing and a function for controlling a filling operation to fill ink, in which the head unit 3 is externally filled with ink.

The transport mechanism 22, which operates under control of the control section 80, transports the medium 12 in the +Y direction. The head moving mechanism 24 has a transport belt 23 stretched across a print range on the medium 12 in the X direction, and also has a carriage 25 that stores the head unit 3 and secures them to the transport belt 23. The head moving mechanism 24, which operates under control of the control section 80, bidirectionally moves the head unit 3 along the X direction, which is the main scanning direction, with the head unit 3 mounted in the carriage 25. When the carriage 25 is bidirectionally moved, the carriage 25 is guided along a guide rail (not illustrated). The liquid storage section 14 may be mounted in the carriage 25 together with the head unit 3.

Each head unit 3 has a plurality of nozzles N used to discharge ink. Nozzles N form nozzle rows Ns, in each of which nozzles N are aligned along the Y direction. Each nozzle N has a discharge port, from which ink is discharged, at a position at which the discharge port faces the medium 12. The head unit 3 is provided for each color of ink stored in the liquid storage section 14. Under control of the control section 80, the head unit 3 discharges ink supplied from the liquid storage section 14 from a plurality of nozzles N toward the medium 12. When liquid is discharged from nozzles N while the head unit 3 is bidirectionally moved, an image or the like is printed on the medium 12. The arrows indicated by dashed lines in FIG. 1 schematically represent movement of ink between the liquid storage section 14 and the head unit 3. In the liquid discharging apparatus 100, ink is circulated by a circulation mechanism 250, which will be described later, between the liquid storage section 14 and the head unit 3 to suppress an increase in the viscosity of ink and the settling of solid components and the like included in the ink.

Figure 2:
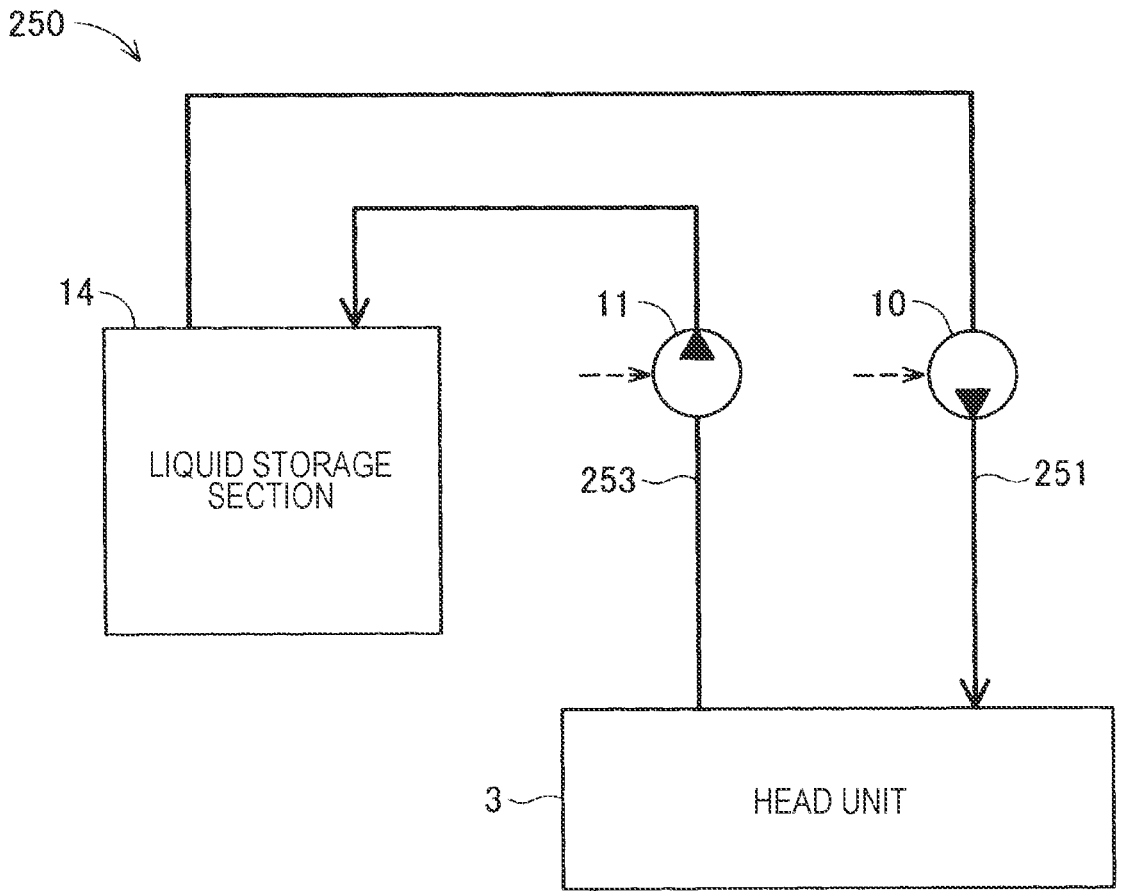
FIG. 2 schematically illustrates the structure of a circulation mechanism.

FIG. 2 schematically illustrates the structure of the circulation mechanism 250. In the circulation mechanism 250, the head unit 3 and liquid storage section 14 are mutually coupled so that ink is circulated between the head unit 3 and the liquid storage section 14 and is supplied again to the head unit 3 while the liquid discharging apparatus 100 is executing a print operation. The circulation mechanism 250 has a supply flow path 251, an ejection flow path 253, a pressurizing section 10, and a depressurizing section 11.

The supply flow path 251 couples the liquid storage section 14 and a pressure chamber 213, which will be described later, together, the pressure chamber 213 being included in the head unit 3, so that ink in the liquid storage section 14 is supplied to the pressure chamber 213. The ejection flow path 253 couples the pressure chamber 213 and liquid storage section 14 together so that ink in the pressure chamber 213 is collected into the liquid storage section 14. In the description below, it will be assumed that the upstream of the supply flow path 251 is on the same side as the liquid storage section 14 and the downstream is on the same side as the head unit 3; and the upstream of the ejection flow path 253 is on the same side as the head unit 3 and the downstream is on the same side as the liquid storage section 14.

The pressurizing section 10, which is provide in the supply flow path 251, operates in response to a control signal from the control section 80 and feeds, to the pressure chamber 213, ink supplied from the liquid storage section 14. The depressurizing section 11, which is provided in the ejection flow path 253, operates in response to a control signal from the control section 80 and feeds, to the liquid storage section 14, ink ejected from the pressure chamber 213. In this embodiment, a positive pressure is applied to the pressurizing section 10 and a negative pressure is applied to the depressurizing section 11, so ink is circulated in the circulation mechanism 250. The pressurizing section 10 and depressurizing section 11 are each a positive displacement pump. Instead of a positive displacement pump, however, the pressurizing section 10 and depressurizing section 11 may be a rotary pump such as a gear pump or vane pump, may be a reciprocating pump such as a plunger pump or piston pump, or may be a diaphragm pump.

Figure 3:
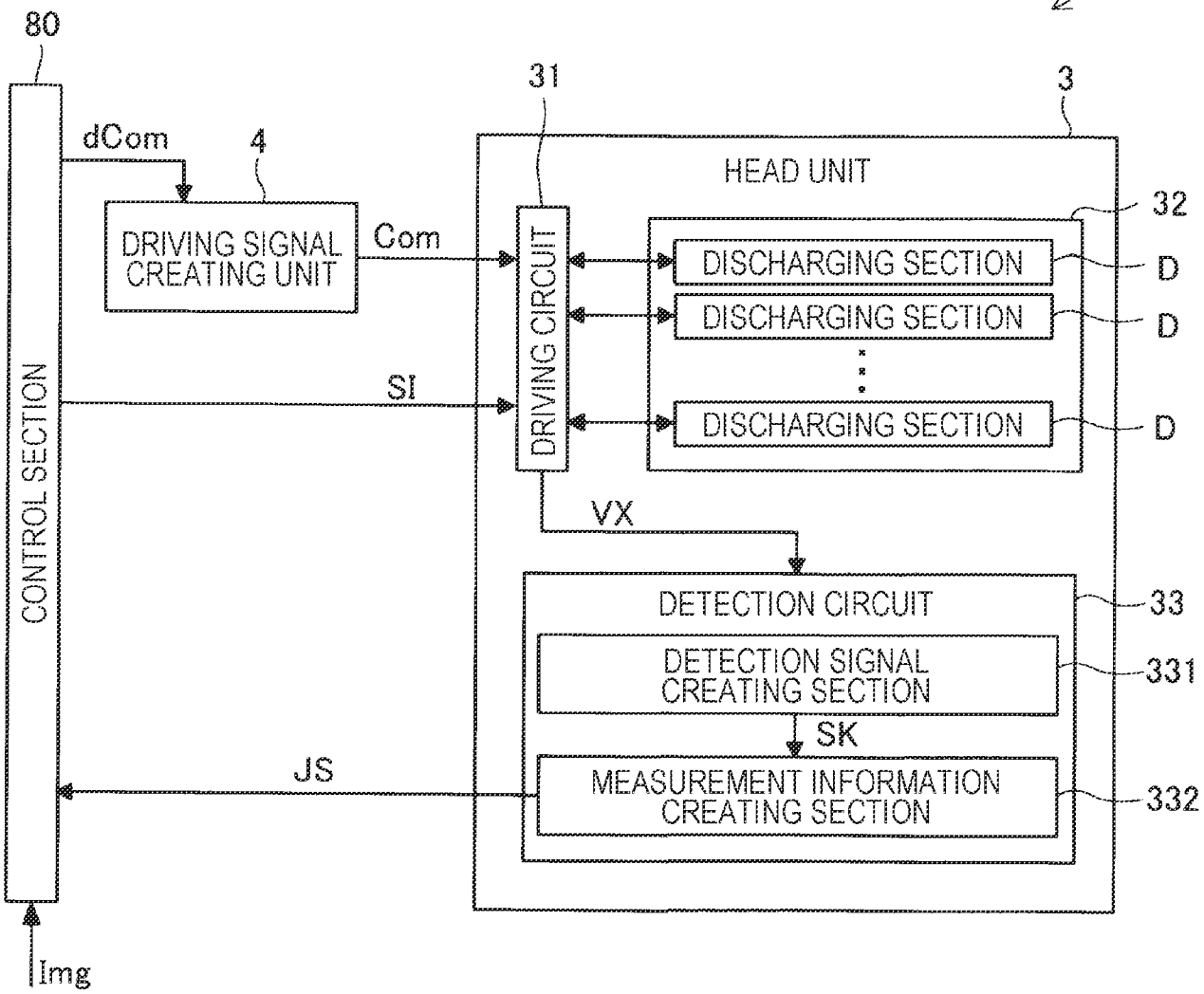
FIG. 3 is a block diagram illustrating the internal structure of the liquid discharging apparatus.

FIG. 3 is a block diagram illustrating the internal structure of the liquid discharging apparatus 100. The liquid discharging apparatus 100 has the control section 80 and head unit 3 as described above and further has a driving signal creating unit 4 that creates a driving signal Com used to drive a discharging section D provided in the head unit 3.

In this embodiment, it will be assumed that the liquid discharging apparatus 100 has one or a plurality of head units 3, one or a plurality of driving signal creating units 4, which are in one-to-one correspondence with the one or a plurality of head units 3. For convenience of explanation, however, the description below will focus on one head unit 3 of the one or plurality of head units 3 and one driving signal creating unit 4 provided in correspondence with the one head unit 3, as illustrated in FIG. 3.

The control section 80 receives image data Img representing an image to be formed by the liquid discharging apparatus 100 from a computer coupled to the liquid discharging apparatus 100 or from any of various types of recording media. The control section 80 executes print processing in which an image represented by the image data Img supplied to the control section 80 is formed on the medium 12.

The control section 80 creates a print signal SI, a waveform specifying signal dCom, and other signals that control the operations of individual sections in the liquid discharging apparatus 100. The waveform specifying signal dCom is a digital signal that stipulates the waveform of the driving signal Com. The driving signal Com is an analog signal that drives the discharging section D. In this embodiment, driving signals Com include a first driving signal Com-A and a second driving signal Com-B. The driving signal creating unit 4, which includes a DA conversion circuit, creates the driving signal Com having a waveform stipulated by the waveform specifying signal dCom. The print signal SI is a digital signal that specifies the type of operation of the discharging section D. Specifically, the print signal SI specifies whether to supply the driving signal Com to the discharging section D to specify the type of operation of the discharging section D.

The head unit 3 has a liquid discharging head 32, a driving circuit 31, and a detection circuit 33.

The liquid discharging head 32 has M discharging sections D. Here, the value M is a natural number greater than or equal to 1. In the description below, to distinguish each of the M discharging sections D in the liquid discharging head 32, they may be sequentially referred to as a first discharging section D, a second discharging section D, . . . , and an M-th discharging section D. In the description below, of the M discharging sections D provided in the liquid discharging head 32, an m-th discharging section D may be represented as a discharging section D[m]. Here, the variable m is a natural number greater than or equal to 1 and smaller than or equal to M. In the description below, when a signal, a constituent element in the liquid discharging apparatus 100, or the like that corresponds to the discharging section D[m] of the M discharging sections D, the reference characters representing the constituent element, the signal, or the like may be suffixed with [m].

Figure 4:
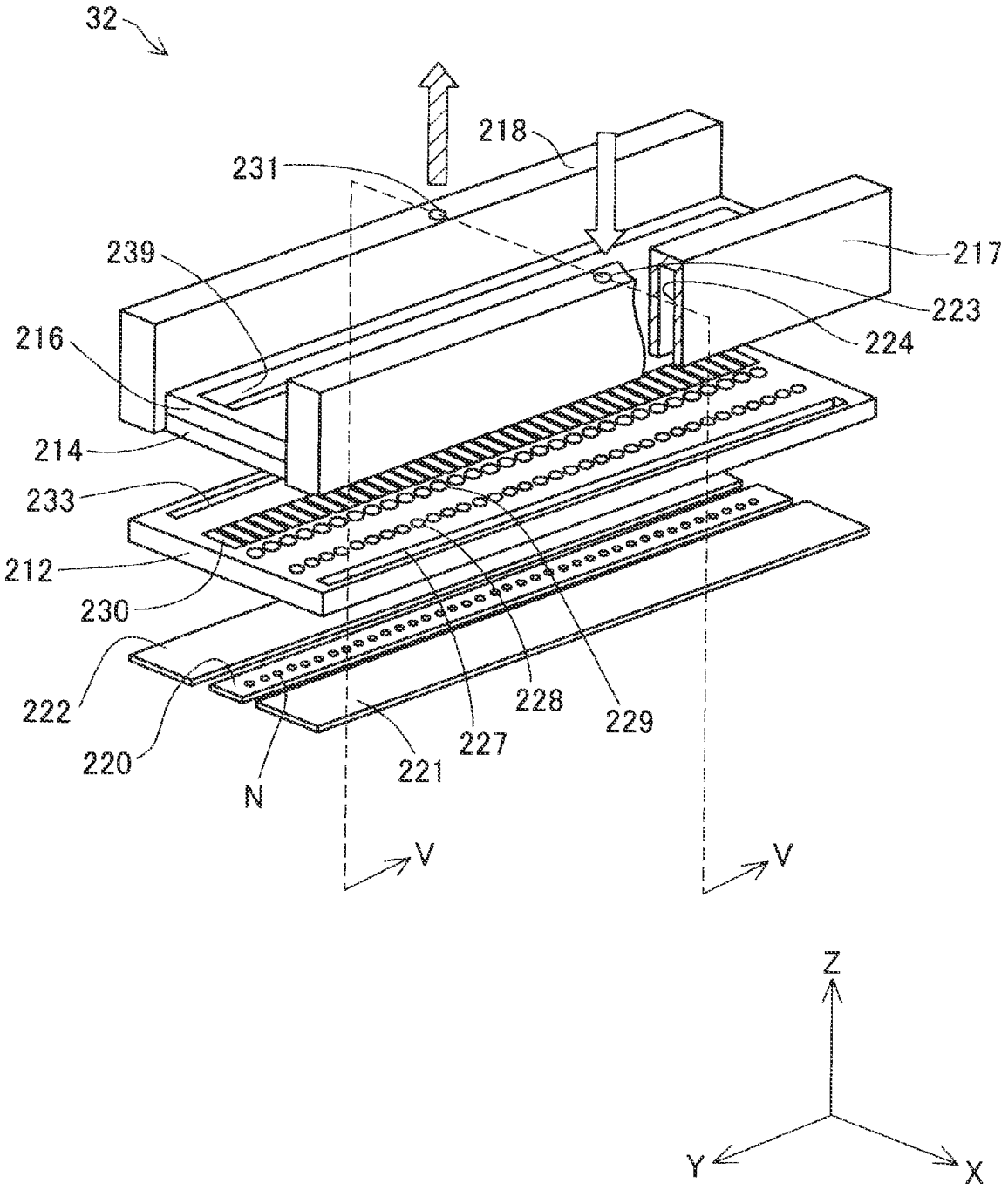
FIG. 4 is an exploded perspective view of the main constituent members of a liquid discharging head.
Figure 5:
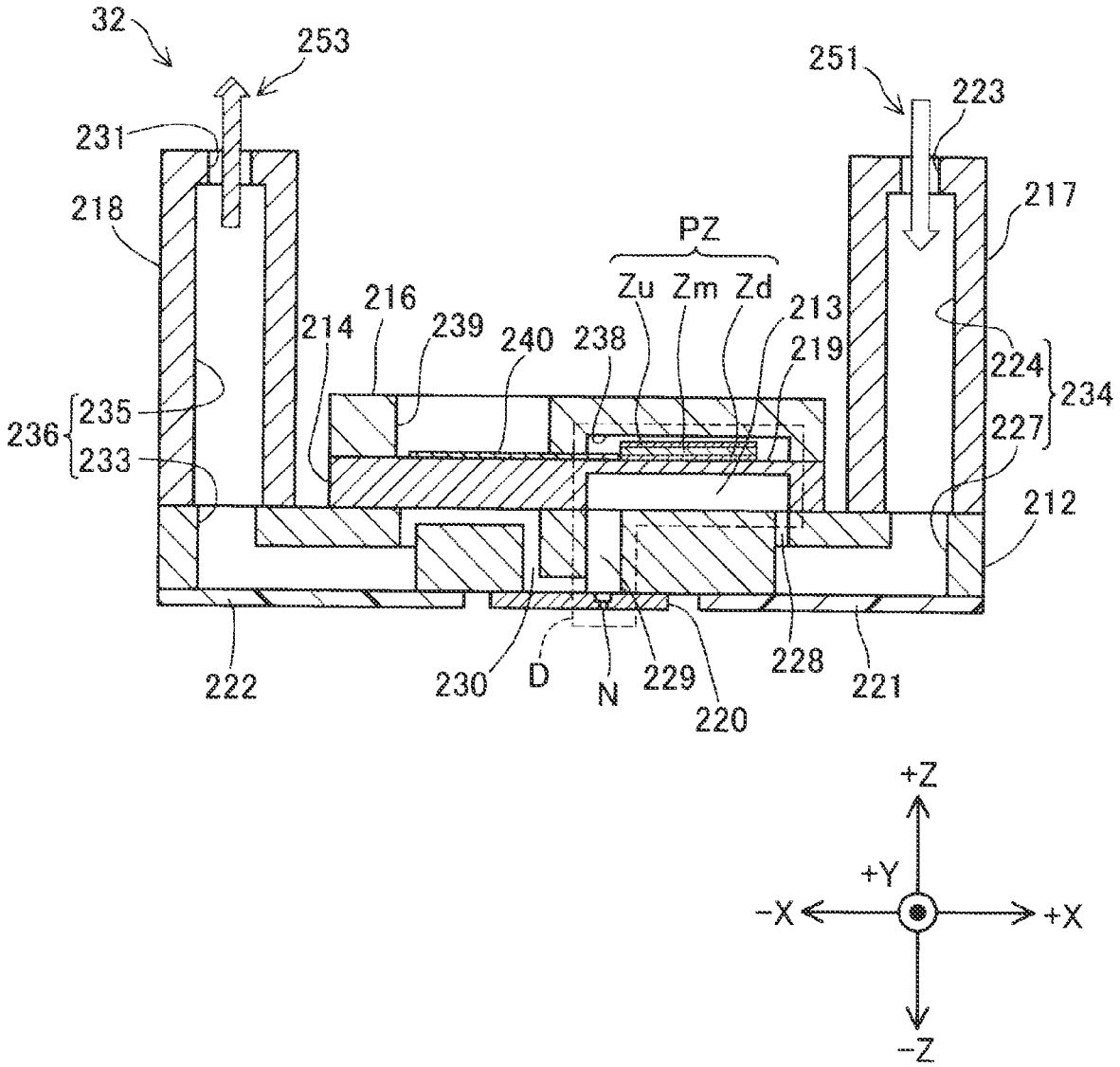
FIG. 5 is a sectional view of the liquid discharging head as taken along line V-V in FIG. 4.

FIG. 4 is an exploded perspective view of the main constituent members of the liquid discharging head 32. FIG. 5 is a sectional view of the liquid discharging head 32 as taken along line V-V in FIG. 4. In FIG. 5, a portion forming the discharging section D is enclosed by dashed lines. The discharging section D includes a piezoelectric element PZ, the pressure chamber 213 in which ink is pressurized when the piezoelectric element PZ is driven, the nozzle N communicating with the pressure chamber 213, and a diaphragm 219.

As illustrated in FIGS. 4 and 5, the liquid discharging head 32 has: a flow path substrate 212 in which flow paths are formed; a pressure chamber substrate 214 in which the pressure chamber 213 is formed; a protection substrate 216 that protects the piezoelectric element PZ; a leading-in flow path substrate 217 having a first inlet 223 coupled to the supply flow path 251; a leading-out flow path substrate 218 having a first outlet 231 coupled to the ejection flow path 253; a nozzle substrate 220 in which a plurality of nozzles N are formed; a first compliance substrate 221; and a second compliance substrate 222.

In plan view from the Z direction, the flow path substrate 212 is a plate-like member elongated in the Y direction, as illustrated in FIG. 4. The leading-in flow path substrate 217 and leading-out flow path substrate 218 are attached at both X-direction ends of the face of the flow path substrate 212 in the +Z direction, either of them being at one end and the other being at the other end. The pressure chamber substrate 214 and protection substrate 216 are laminated and secured in an area between the leading-in flow path substrate 217 and the leading-out flow path substrate 218. The nozzle substrate 220 is joined to the face of the flow path substrate 212 in the −Z direction at the central portion in the X direction. The first compliance substrate 221 is joined to the face on the same side as the +X direction and the second compliance substrate 222 is joined to the face on the same side as the −X direction, with the nozzle substrate 220 intervening between the first compliance substrate 221 and the second compliance substrate 222.

As illustrated in FIG. 5, the leading-in flow path substrate 217 internally has a leading-in liquid chamber 224. The leading-in liquid chamber 224 is open to the face of the leading-in flow path substrate 217 in the −Z-direction and communicates with a first liquid chamber 227 formed in the flow path substrate 212, forming a first common liquid chamber 234. In the face of the leading-in flow path substrate 217 in the +Z direction, a first inlet 223 is formed at the central portion in the Y direction. The first inlet 223 communicates with the supply flow path 251. Ink supplied from the liquid storage section 14 through the l supply flow path 251 flows into the first common liquid chamber 234 through the first inlet 223, as indicated by the open arrow.

As illustrated in FIGS. 4 and 5, the flow path substrate 212 has the first liquid chamber 227 described above, first individual communicating paths 228, nozzle communicating paths 229, second individual communicating paths 230, and a second liquid chamber 233, which are located in that order from the +X direction toward the −X direction. The first liquid chamber 227 extends along the Y direction, in which nozzles N are aligned in rows, and communicates with a plurality of pressure chambers 213. Each first individual communicating path 228 is formed in correspondence with the relevant pressure chamber 213 so as to have the pressure chamber 213 and first liquid chamber 227 individually communicate with each other.

As illustrated in FIG. 5, the pressure chamber 213 is a liquid chamber elongated in the X direction and is open to the face of the pressure chamber substrate 214 in the −Z direction. The pressure chamber substrate 214 is joined to the face of the flow path substrate 212 in the +Z direction, closing the opening and defining the pressure chamber 213. On the pressure chamber substrate 214, the diaphragm 219, which is flexible, is provided at a position at which the diaphragm 219 faces the pressure chamber 213.

The diaphragm 219 is a thin-plate member that undergoes displacement in response to the driving of the piezoelectric element PZ. On the diaphragm 219, the piezoelectric element PZ is provided at a portion facing the pressure chamber 213.

Piezoelectric elements PZ are individually provided in correspondence with pressure chambers 213. Each piezoelectric element PZ has an upper electrode Zu, a lower electrode Zd, and a piezoelectric body Zm disposed between the upper electrode Zu and the lower electrode Zd. The lower electrode Zd is electrically coupled to a feed line Lb set to a potential VBS indicated in FIG. 6. A supply driving signal Vin is supplied to the upper electrode Zu by the driving circuit 31, which will be described later, and a voltage is applied across the upper electrode Zu and lower electrode Zd. Then, the piezoelectric element PZ undergoes displacement in the +Z direction or −Z direction, depending on the applied voltage. As a result, the piezoelectric element PZ vibrates. The lower electrode Zd is joined to the diaphragm 219. Therefore, when the piezoelectric element PZ is driven in response to the supply driving signal Vin and vibrates, the diaphragm 219 also vibrates. Due to the vibration of the diaphragm 219, the volume of the pressure chamber 213 and pressure in the pressure chamber 213 change, causing ink filled in the pressure chamber 213 to be discharged from the nozzle N.

In plan view from the Z direction, the first compliance substrate 221 is a plate-like member elongated in the Y direction. The first compliance substrate 221 is a thin-film member formed from poly-phenylene sulfide (PPS), aromatic polyamide, or the like. The first compliance substrate 221 absorbs pressure vibration that would otherwise propagate from each pressure chamber 213 to the interior of the first common liquid chamber 234 when an ink droplet is discharged from the relevant nozzle N.

The nozzle communicating path 229 passes through the flow path substrate 212 in the Z direction. The nozzle communicating path 229 causes the relevant nozzle N and the pressure chamber 213 corresponding to the nozzle N to communicate with each other.

The nozzle substrate 220 is joined to the face of the flow path substrate 212 in the —Z direction, closing the openings of the nozzle communicating paths 229 and second individual communicating paths 230. A plurality of nozzles N are formed in the nozzle substrate 220 so as to be arranged side by side by, for example, performing dry etching, wet etching, or the like for a monocrystalline silicon (Si) substrate. Each nozzle N is a substantially circular through-hole that extends through the nozzle substrate 220 in the Z direction.

One second individual communicating path 230 is formed in correspondence to each nozzle N. The second individual communicating path 230 is formed like a groove by performing wet etching or the like for the flow path substrate 212. The end of the second individual communicating path 230 in the +X direction communicates with the relevant nozzle communicating path 229, and the end in the —X direction communicates with the second liquid chamber 233.

As illustrated in FIG. 4, the second liquid chamber 233 extends along the Y direction. As illustrated in FIG. 5, the second liquid chamber 233 communicates with a plurality of nozzles N through the second individual communicating paths 230. On the same side as the —X direction, the second liquid chamber 233 has an opening facing in the +Z direction. The opening communicates with the lead-in liquid chamber 235 in the leading-out flow path substrate 218. The second liquid chamber 233 also has another opening on the same side as the —Z direction. The opening is closed by the second compliance substrate 222.

The leading-out flow path substrate 218 internally has a lead-in liquid chamber 235. The lead-in liquid chamber 235 is open to the face of the leading-out flow path substrate 218 in the —Z-direction and communicates with the second liquid chamber 233 in the flow path substrate 212, forming a second common liquid chamber 236. Ink in the second common liquid chamber 236 is fed out of the first outlet 231 to the ejection flow path 253 and is then returned to the liquid storage section 14, as indicated by the hatched arrow.

The second compliance substrate 222, which is formed from a material similar to the material of the first compliance substrate 221, is a plate-like member elongated in the Y direction. The second compliance substrate 222 absorbs pressure vibration that would otherwise propagate from each pressure chamber 213 to the second common liquid chamber 236 when an ink droplet is discharged from the relevant nozzle N.

The protection substrate 216 is formed in correspondence with areas in which the piezoelectric elements PZ disposed on the diaphragms 219 are formed. The protection substrate 216 internally has a storage space 238. In the storage space 238, the piezoelectric elements PZ are stored and are joined to the surface of the pressure chamber substrate 214 in the in the +Z direction. The protection substrate 216 has lead electrodes 240 drawn out from the piezoelectric elements PZ, and also has a through-opening 239 passing through the protection substrate 216 in the Z direction.

Referring again to FIG. 3, the driving circuit 31 disposed in the head unit 3 selectively specifies whether to supply the driving signal Com to the upper electrode Zu[m] of the piezoelectric element PZ[m] included in the discharging section D[m], in response to the print signal SI. In the description below, of the driving signals Com, the driving signal Com supplied to the discharging section D[m] may be referred to as the supply driving signal Vin[m]. The driving circuit 31 also selectively specifies whether to supply, to the detection circuit 33, a detection potential signal VX that indicates the potential of the upper electrode Zu[m] of the piezoelectric element PZ[m] included in the discharging section D[m], which is one of the M discharging sections D[1] to D[M], in response to the print signal SI. In the description below, when the detection potential signal VX is supplied from the discharging section D[m] to the detection circuit 33, the discharging section D[m] will be referred to as the eligible-for-decision discharging section DS. When the discharging section D[m] is not the eligible-for-decision discharging section DS, the discharging section D[m] will be referred to as the not-eligible-for-decision discharging section DP.

The detection circuit 33 has a detection signal creating section 331 and a measurement information creating section 332. The detection signal creating section 331 creates a detection signal SK according to the detection potential signal VX supplied from the eligible-for-decision discharging section DS through the driving circuit 31. Specifically, the detection circuit 33 creates the detection signal SK by amplifying the detection potential signal VX and removing a noise component. The detection signal SK is equivalent to a signal detected by the detection circuit 33 after the driving element has been driven by the driving circuit 31. The measurement information creating section 332 then creates, from the detection signal SK, measurement information JS that represents the cycle NTC of the detection signal SK. The cycle NTC is, for example, a time during which the voltage of the detection signal SK rises from 0, reaches a peak with a positive value, drops, reaches a peak with a negative value, rises again, and reaches 0. For example, the measurement information creating section 332 calculates an average value for cycles included in the detection signal SK as the cycle NTC of the detection signal SK. Instead of the average value for cycles included in the detection signal SK, however, the measurement information creating section 332 may calculate a representative value such as the maximum value or median value as the cycle NTC of the detection signal SK.

The control section 80 executes filling state decision processing in a filling operation, which will be described later. In filling state decision processing, the discharging section D[m] is driven by the eligible-for-decision discharging section DS and a decision is made about the filling state of ink in the discharging section D[m] driven as the eligible-for-decision discharging section DS. In this filling state decision processing, the control section 80 supplies the print signal SI to the driving circuit 31 so that the discharging section D[m] is driven as the eligible-for-decision discharging section DS. The control section 80 then supplies the print signal SI to the driving circuit 31 so that the detection potential signal VX is supplied from the discharging section D[m] to be driven as the eligible-for-decision discharging section DS to the detection circuit 33. Then, the detection circuit 33 creates the detection signal SK according to the detection potential signal VX supplied from the eligible-for-decision discharging section DS through the driving circuit 31, and further creates measurement information JS that represents the cycle NTC of the detection signal SK according to the detection signal SK. The control section 80 makes a decision about the filling state of ink in the discharging section D according to the measurement information JS supplied from the detection circuit 33.

Figure 6:
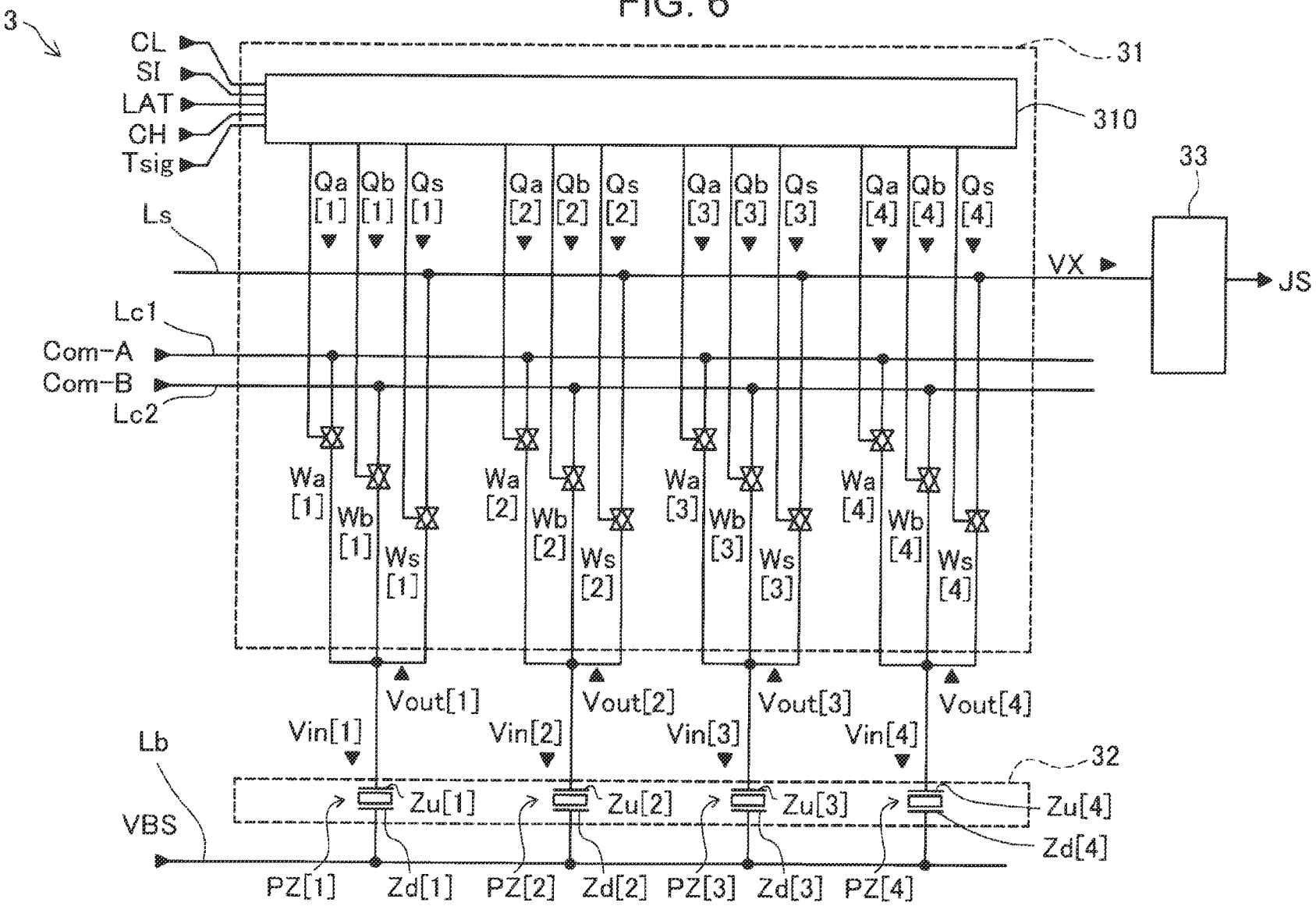
FIG. 6 is a block diagram illustrating the electrical structure of a head unit.

FIG. 6 is a block diagram illustrating the electrical structure of the head unit 3. As described above, the liquid discharging head 32 has the driving circuit 31, liquid discharging head 32, and detection circuit 33. In FIG. 6, a case is exemplified in which four discharging sections D are provided in the liquid discharging head 32, that is, M is 4.

The head unit 3 has: a first line Lc1 through which the first driving signal Com-A is supplied from the driving signal creating unit 4; a second line Lc2 through which the second driving signal Com-B is supplied from the driving signal creating unit 4; and a third line Ls through which the detection potential signal VX is supplied to the detection circuit 33.

The driving circuit 31 has: M first switches Wa[1] to Wa[M], which are in one-to-one correspondence with M discharging sections D[1] to D[M]; M second switches Wb[1] to Wb[M], which are in one-to-one correspondence with M discharging sections D[1] to D[M]; M third switches Ws[1] to Ws[M], which are in one-to-one correspondence with M discharging sections D[1] to D[M]; and a coupling state specifying circuit 310 that specifies the coupling state of each switch. The coupling state specifying circuit 310 creates a first coupling state specifying signal Qa[m] that specifies whether to turn on or off the first switch Wa[m], a second coupling state specifying signal Qb[m] that specifies whether to turn on or off the second switch Wb[m], and a third coupling state specifying signal Qs[m] that specifies whether to turn on or off the third switch Ws[m], in response to at least part of the print signal SI, a latch signal LAT, a period specifying signal Tsig, and a change signal CH, which are supplied from the control section 80.

The first switch Wa[m] selectively creates or breaks an electrical coupling between the first line Lc1 and the upper electrode Zu[m] of the piezoelectric element PZ[m] disposed in the discharging section D[m], according to the first coupling state specifying signal Qa[m]. In this embodiment, the first switch Wa[m] is turned on when the first coupling state specifying signal Qa[m] is high and is turned off when the signal is low. When the first switch Wa[m] is turned on, the first driving signal Com-A supplied to the first line Lc1 is supplied to the upper electrode Zu[m] of the discharging section D[m] as the supply driving signal Vin[m].

The second switch Wb[m] selectively creates or breaks an electrical coupling between the second line Lc2 and the upper electrode Zu[m] of the piezoelectric element PZ[m] disposed in the discharging section D[m], according to the second coupling state specifying signal Qb[m]. In this embodiment, the second switch Wb[m] is turned on when the second coupling state specifying signal Qb[m] is high and is turned off when the signal is low. When the second switch Wb[m] is turned on, the second driving signal Com-B supplied to the second line Lc2 is supplied to the upper electrode Zu[m] of the discharging section D[m] as the supply driving signal Vin[m].

The third switch Ws[m] selectively creates or breaks an electrical coupling between the third line Ls and the upper electrode Zu[m] of the piezoelectric element PZ[m] disposed in the discharging section D[m], according to the third coupling state specifying signal Qs[m]. In this embodiment, the third switch Ws[m] is turned on when the third coupling state specifying signal Qs[m] is high and is turned off when the signal is low. When the third switch Ws[m] is turned on, the potential Vout[m] of the upper electrode Zu[m] of the discharging section D[m] is supplied to the detection circuit 33 through the third line Ls as the detection potential signal VX.

According to the detection potential signal VX supplied from the third line Ls, the detection circuit 33 creates the detection signal SK having a waveform matching the waveform of the detection potential signal VX.

Figure 7:
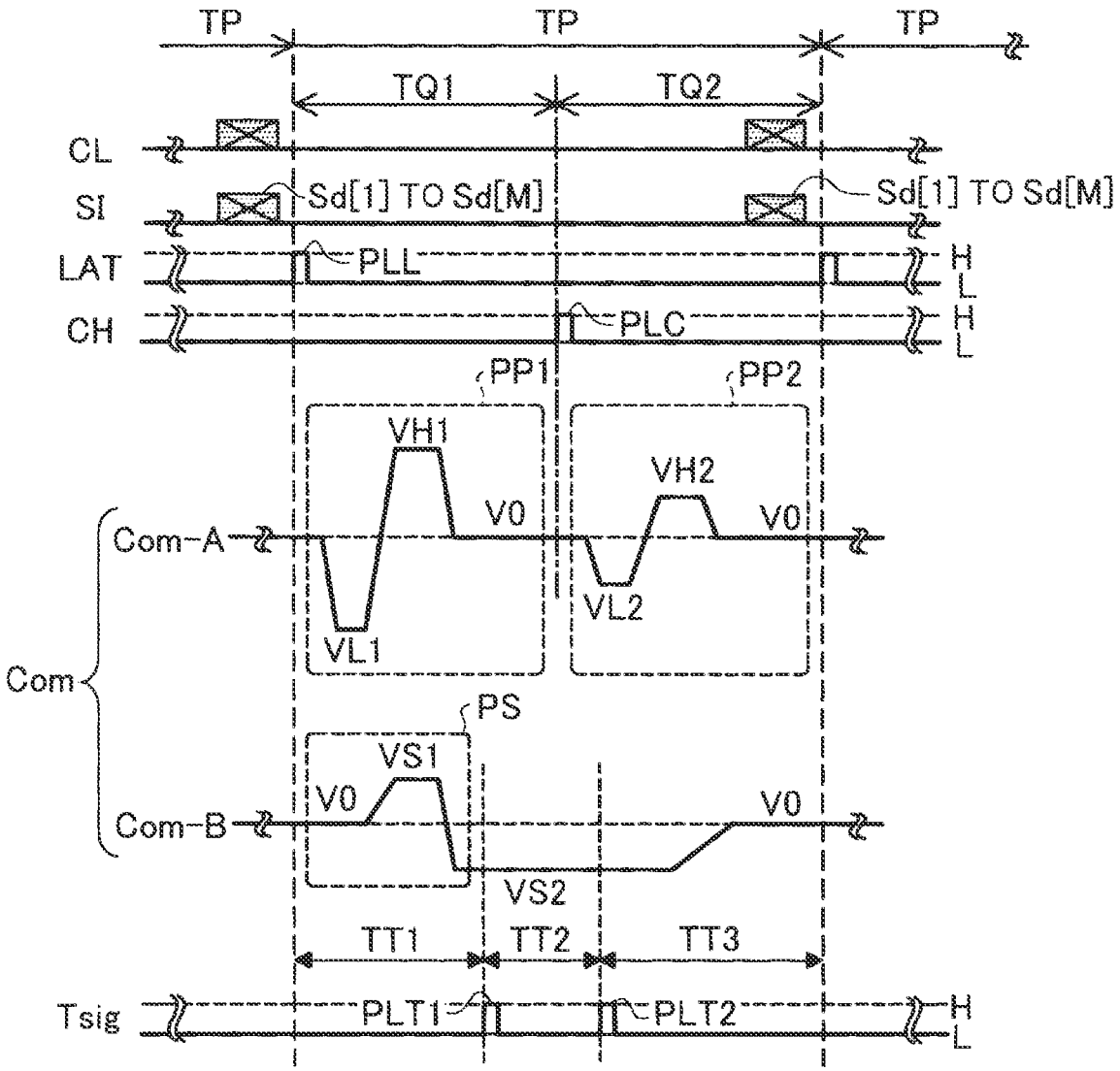
FIG. 7 is a timing diagram illustrating the operation of the liquid discharging apparatus.

FIG. 7 is a timing diagram illustrating the operation of the liquid discharging apparatus 100 in a unit period TP. When the liquid discharging apparatus 100 performs a filling operation, which will be described later, or print processing, one or a plurality of unit periods TP are set as the operation period of the liquid discharging apparatus 100. In each unit period TP, the liquid discharging apparatus 100 can drive discharging sections D to perform print processing or a filling operation.

As illustrated in FIG. 7, the control section 80 outputs the latch signal LAT having pulses PLL. Thus, the control section 80 stipulates the unit period TP as a period from the rising edge of a first pulse PLL to the rising edge of a second pulse PLL, which follows the first pulse PLL.

The control section 80 outputs the change signal CH having a pulse PLC in a unit period TP. The control section 80 divides the unit period TP into a control period TQ1 from the rising edge of the first pulse PLL to the rising edge of the pulse PLC and a control period TQ2 from the rising edge of the pulse PLC to the rising edge of the second pulse PLL.

The control section 80 outputs the period specifying signal Tsig having a pulse PLT1 and a pulse PLT2 in a unit period TP. The control section 80 divides the unit period TP into a control period TT1 from the rising edge of the first pulse PLL to the rising edge of the pulse PLT1, a control period TT2 from the rising edge of the pulse PLT1 to the rising edge of the pulse PLT2, and a control period TT3 from the rising edge of the pulse PLT2 to the rising edge of the second pulse PLL.

The print signal SI in this embodiment includes M individually specifying signals Sd[1] to Sd[M] in one-to-one correspondence with M discharging sections D[1] to D[M]. When the liquid discharging apparatus 100 executes print processing or a filling operation, the individually specifying signal Sd[m] specifies a mode in which the discharging section D[m] is driven in each unit period TP.

Before each unit period TP starts, the control section 80 supplies the print signal SI including individually specifying signals Sd[1] to Sd[M] to the coupling state specifying circuit 310 in synchronization with a clock signal CL, as illustrated in FIG. 7. The coupling state specifying circuit 310 creates the first coupling state specifying signal Qa[m], second coupling state specifying signal Qb[m], and third coupling state specifying signal Qs[m] in the unit period TP, according to the individually specifying signal Sd[m].

In this embodiment, it will be assumed that the discharging section D[m] can form any of a large dot, a medium dot smaller than the large dot, and a small dot smaller than the medium dot in a unit period TP. In this embodiment, it will also be assumed that the individually specifying signal Sd[m] can take any one of five values 1 to 5 that specify, in the unit period TP, the discharging section D[m] as a large-dot forming discharging section DP-1, which is a not-eligible-for-decision discharging section DP that discharges ink by an amount equivalent to a large dot (when 1 is taken), a medium-dot forming discharging section DP-2, which is a not-eligible-for-decision discharging section DP that discharges ink by an amount equivalent to a medium dot (when 2 is taken), a small-dot forming discharging section DP-3, which is a not-eligible-for-decision discharging section DP that discharges ink by an amount equivalent to a small dot (when 3 is taken), a dot non-forming discharging section DP-B, which is a not-eligible-for-decision discharging section DP that does not discharge ink (when 4 is taken), and the eligible-for-decision discharging section DS (when 5 is taken).

In this embodiment, the first driving signal Com-A has a waveform PP1 present in the control period TQ1 and a waveform PP2 present in the control period TQ2, as illustrated in FIG. 7. The waveform PP1 starts from a reference potential V0, passes through a potential VL1 lower than the reference potential V0, passes through a potential VH1 higher than the reference potential V0, and returns to the reference potential V0. When the supply driving signal Vin[m] having the waveform PP1 is supplied to the discharging section D[m], the waveform PP1 is defined so that ink is supplied from the discharging section D[m] by an ink amount D1. The waveform PP2 starts from the reference potential V0, passes through a potential VL2 lower than the reference potential V0, passes through a potential VH2 higher than the reference potential V0, and returns to the reference potential V0. When the supply driving signal Vin[m] having the waveform PP2 is supplied to the discharging section D[m], the waveform PP2 is defined so that ink is supplied from the discharging section D[m] by an ink amount D2. In this embodiment, the ink amount D1 is the amount of ink equivalent to a medium dot; the ink amount D2, which is smaller than the ink amount D1, is the amount of ink equivalent to a small dot; and the sum of the ink amount D1 and ink amount D2 is the amount of ink equivalent to a large dot.

In this embodiment, it will be assumed as an example that when the potential of the supply driving signal Vin[m] supplied to the discharging section D[m] is high, the volume of the pressure chamber 213 included in the discharging section D[m] is smaller than when the potential is low. Therefore, when the discharging section D[m] is driven by the supply driving signal Vin[m] having the waveform PP1 or waveform PP2, the potential of the supply driving signal Vin[m] changes from low to high, so ink in the discharging section D[m] is discharged from the nozzle N.

In this embodiment, the second driving signal Com-B has a waveform PS present in a unit period TP, as illustrated in FIG. 7. In the control period TT1, the waveform PS starts from the reference potential V0, passes through a potential VS1 higher than the reference potential V0, and changes to a potential VS2 lower than the reference potential V0. Then, the waveform PS maintains the potential VS2 in the control period TT2, and changes from the potential VS2 to the reference potential V0 in the control period TT3.

In this embodiment, it will be assumed as an example that the waveform PS is defined so that when the supply driving signal Vin[m] having the waveform PS is supplied to discharging section D[m], ink is not discharged from the discharging section D[m]. In this embodiment, for example, it will be assumed as an example that when the discharging section D[m] is driven by the supply driving signal Vin[m] having the waveform PS, the waveform PS is defined so that the pressure chamber 213 in the discharging section D[m] has a smaller volume when the potential of the supply driving signal Vin[m] is the potential VS1 than when the potential of the supply driving signal Vin[m] is the potential VS2.

FIG. 8 shows the relationship between individually specifying signals and coupling state specifying signals. As illustrated in FIG. 8, when the individually specifying signal Sd[m] indicates a value of 1, which specifies the discharging section D[m] as the large-dot forming discharging section DP-1 in a unit period TP, the coupling state specifying circuit 310 sets the first coupling state specifying signal Qa[m] to the high level across the control period TQ1 and control period TQ2. In this case, the first switch Wa[m] is turned on across the unit period TP. In the unit period TP, therefore, the discharging section D[m] is driven by the supply driving signal Vin[m] having the waveform PP1 and waveform PP2 and discharges ink by an amount equivalent to a large dot.

When the individually specifying signal Sd[m] indicates a value of 2, which specifies the discharging section D[m] as the medium-dot forming discharging section DP-2 in a unit period TP, the coupling state specifying circuit 310 sets the first coupling state specifying signal Qa[m] to the high level in the control period TQ1. In this case, the first switch Wa[m] is turned on in the control period TQ1. In the unit period TP, therefore, the discharging section D[m] is driven by the supply driving signal Vin[m] having the waveform PP1 and discharges ink by an amount equivalent to a medium dot.

When the individually specifying signal Sd[m] indicates a value of 3, which specifies the discharging section D[m] as the small-dot forming discharging section DP-3 in a unit period TP, the coupling state specifying circuit 310 sets the first coupling state specifying signal Qa[m] to the high level in the control period TQ2. In this case, the first switch Wa[m] is turned on in the control period TQ2. In the unit period TP, therefore, the discharging section D[m] is driven by the supply driving signal Vin[m] having the waveform PP2 and discharges ink by an amount equivalent to a small dot.

When the individually specifying signal Sd[m] indicates a value of 4, which specifies the discharging section D[m] as the dot non-forming discharging section DP-B in a unit period TP, the coupling state specifying circuit 310 sets the first coupling state specifying signal Qa[m], second coupling state specifying signal Qb[m], and third coupling state specifying signal Qs[m] to the low level across the unit period TP. In this case, the first switch Wa[m], second switch Wb[m], and third switch Ws[m] are turned off across the unit period TP. In the unit period TP, therefore, the supply driving signal Vin[m] is not supplied to the discharging section D[m] and ink is not thereby discharged from the discharging section D[m].

When the individually specifying signal Sd[m] indicates a value of 5, which specifies the discharging section D[m] as the eligible-for-decision discharging section DS in a unit period TP, the coupling state specifying circuit 310 sets the second coupling state specifying signal Qb[m] to the high level in the control period TT1 and control period TT3 and also sets the third coupling state specifying signal Qs[m] to the high level in the control period TT2. In this case, the first switch Wa[m] is turned on in the control period TT1 and control period TT3, and the third switch Ws[m] is turned on in the control period TT2. In the control period TT1, therefore, the discharging section D[m] specified as the eligible-for-decision discharging section DS is driven by the supply driving signal Vin[m] having the waveform PS, and as a result, vibration occurs in the discharging section D[m]. The vibration remains in the control period TT2, immediately following the control period TT1, as well. In the control period TT2, the potential of the upper electrode Zu[m] disposed in the discharging section D[m] changes due to vibration remaining in the discharging section D[m]. In the control period TT2, therefore, the potential Vout[m] of the upper electrode Zu[m] is supplied to the detection circuit 33 through the third switch Ws[m] as the detection potential signal VX. The waveform of the detection potential signal VX detected from the discharging section D[m] in the control period TT2 indicates the waveform of vibration remaining in the discharging section D[m] in the control period TT2. The waveform of the detection signal SK created according to the detection potential signal VX detected from the discharging section D[m] in the control period TT2 indicates the waveform of vibration remaining in the discharging section D[m] in the control period TT2.

The detection circuit 33 measures the cycle NTC of the waveform of the detection signal SK and creates measurement information JS indicating the measured cycle NTC.

Figure 9:
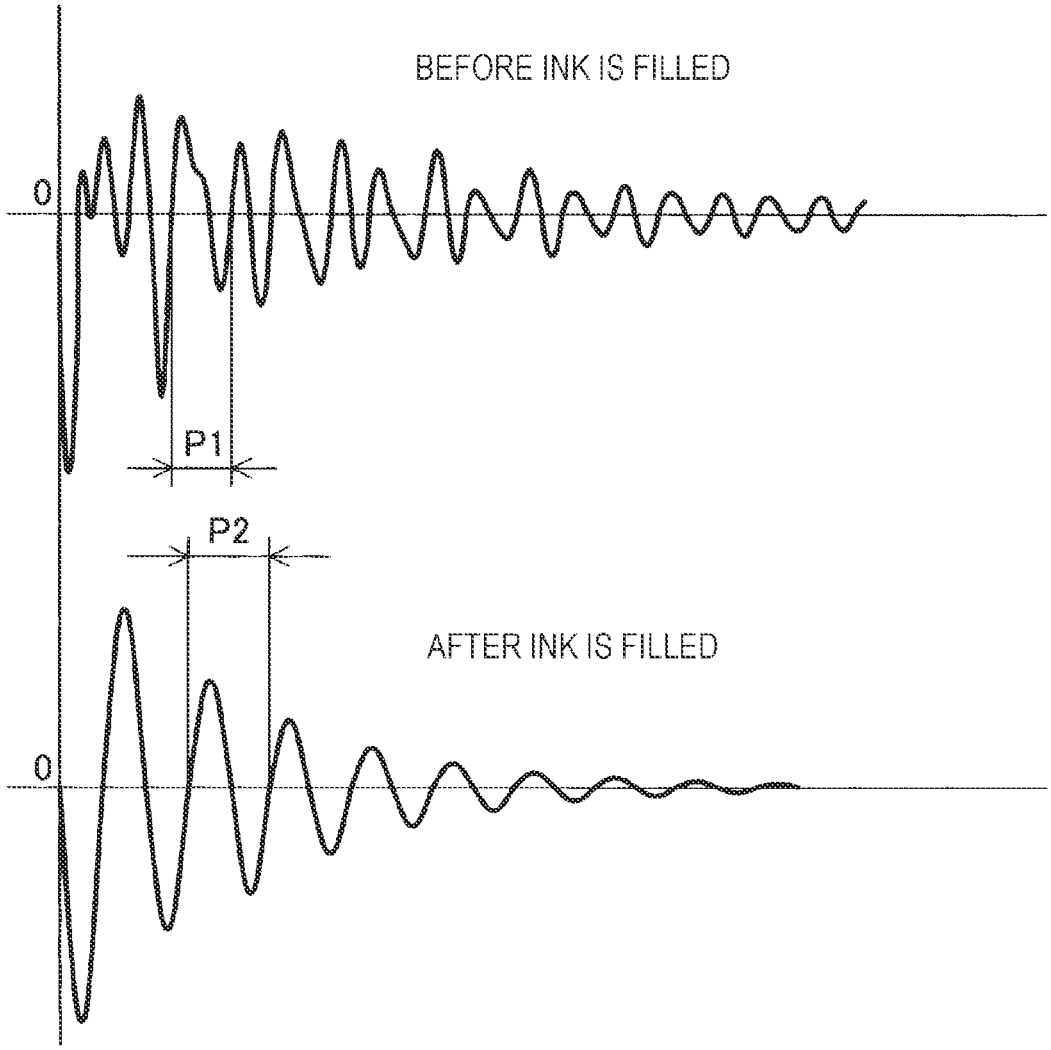
FIG. 9 illustrates an example of residual vibration waveforms before and after ink is filled.

FIG. 9 illustrates an example of residual vibration waveforms before and after ink is filled. As described above, the waveform of the detection signal SK indicates the waveform of vibration remaining in the discharging section D[m] driven as the eligible-for-decision discharging section DS. In general, vibration remaining in the discharging section D[m] has a natural vibration cycle determined by the shape of the nozzle N included in the discharging section D[m], the weight of ink filled in the pressure chamber 213 included in the discharging section D[m], the viscosity of ink filled in the pressure chamber 213 included in the discharging section D[m], and the like. Therefore, when the pressure chamber 213 in the discharging section D[m] is not filled with ink, the cycle P1 of vibration remaining in the discharging section D[m] is generally shorter than the cycle P2 of vibration remaining in the discharging section D[m] when the pressure chamber 213 is filled with ink, as illustrated in FIG. 9. As described above, the waveform of the detection signal SK indicates the waveform of vibration remaining in the discharging section D[m] driven as the eligible-for-decision discharging section DS. That is, the cycle NTC of the detection signal SK is the cycle of the waveform of vibration remaining in the discharging section D[m] driven as the eligible-for-decision discharging section DS. Therefore, the control section 80 can determine the filling state of ink in the discharging section D[m] driven as the eligible-for-decision discharging section DS, according to the cycle NTC indicated in measurement information JS.

Figure 10:
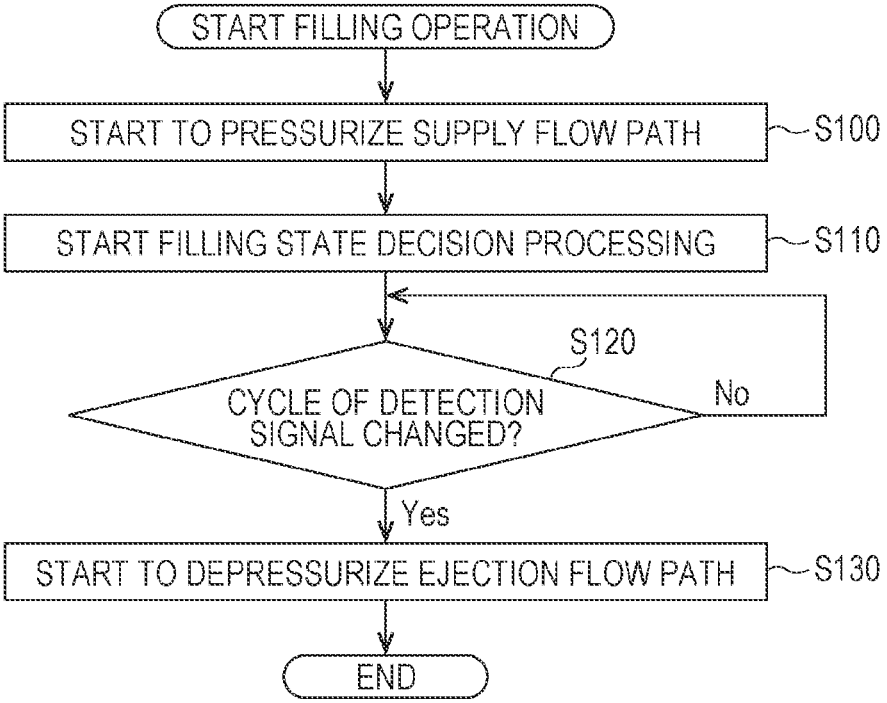
FIG. 10 is a flowchart illustrating a filling operation in the first embodiment.

FIG. 10 is a flowchart illustrating a filling operation that implements a liquid filling method in the first embodiment. The filling operation is executed by the control section 80. In the filling operation, ink is initially filled in the discharging section D that is yet to be filled with ink. The filling operation is executed when, for example, the liquid discharging apparatus 100 is operated for the first time. In this embodiment, the filling operation is executed for all of the M discharging sections D included in the liquid discharging head 32. It will be assumed that the pressurizing section 10 and depressurizing section 11 are yet to be driven at the start of the filling operation.

When this filling operation starts to be executed, the control section 80 first pressurizes the supply flow path 251 by using the pressurizing section 10 to start to supply ink from the liquid storage section 14 to the discharging section D in step S100.

After having started to supply ink, the control section 80 starts filling state decision processing described above in step S110. In this filling state decision processing, the control section 80 repeatedly causes the driving circuit 31 to drive the piezoelectric element PZ and the detection circuit 33 to detect the detection signal SK alternately to acquire measurement information JS from the detection circuit 33 for each unit period TP, the measurement information JS indicating the cycle of the waveform of the detection signal SK matching residual vibration in the discharging section D.

In step S120, the control section 80 decides whether the cycle of the detection signal SK has changed, according to measurement information JS obtained from the detection circuit 33. When the control section 80 decides that the cycle of the detection signal SK has not changed, the control section 80 determines that the discharging section D is not filled, in which case the control section 80 executes step S120 again and continues to execute the filling state decision processing.

In step S120, when the control section 80 decides that the cycle of the detection signal SK has changed, specifically when the control section 80 decides that the cycle of the detection signal SK has become longer that the cycle of a previous detection signal SK., the control section 80 determines that the discharging section D is filled. The control section 80 then controls the depressurizing section 11 to start to depressurize the ejection flow path 253 in step S130, after which the control section 80 terminates the filling operation. Pressure in depressurization by the depressurizing section 11 is determined according to a balance with pressure in pressurization by the pressurizing section 10. Specifically, pressure in depressurization has been set so as to be enough to prevent ink from being discharged from the nozzle N due to the difference between pressure in depressurization and pressure in pressurization. In step S120, when the cycle of the recent detection signal SK has become longer than the cycle of the previous detection signal SK or the average of the cycles of a predetermined number of detection signals SK counted up to the previous detection signal SK by a predetermined ratio or higher, it can be determined that the cycle of the detection signal SK has become longer.

In this embodiment, upon termination of the filling operation, the pressurizing section 10 and depressurizing section 11 remain driven, that is, ink is circulated. However, the pressurizing section 10 and depressurizing section 11 may be stopped to stop circulation of ink.

According to the first embodiment described so far, the filling operation, in which the liquid discharging head 32 is filled with ink, is terminated according to the detection signal SK detected by the detection circuit 33 after the piezoelectric element PZ is driven by the driving circuit 31. This enables the liquid discharging head 32 to be filled with ink without excess or deficiency. Particularly, in this embodiment, driving by the driving circuit 31 and detection by the detection circuit 33 are alternately performed, the driving waveform and detection waveform can be separated from each other. This can increase precision in detection of the detection signal SK. In addition, since the filling operation is terminated when a change occurs in a signal detected by the detection circuit 33, specifically when the cycle of residual vibration, the cycle being indicated by the detection signal SK, changes to a longer cycle, it can be precisely detected that the liquid discharging head 32 has been filled with ink.

The liquid discharging apparatus 100 in this embodiment has the supply flow path 251 that supplies ink to the pressure chamber 213, and also has the pressurizing section 10 that pressurizes the supply flow path 251. The control section 80 causes the pressurizing section 10 to perform pressurization during a filling operation. This enables the liquid discharging head 32 to be efficiently filled with ink.

The liquid discharging apparatus 100 in this embodiment has the ejection flow path 253 through which ink is ejected from the pressure chamber 213, and also has the depressurizing section 11 that depressurizes the ejection flow path 253. The control section 80 causes the depressurizing section 11 to perform depressurization during a filling operation. This can suppresses leak of ink from the liquid discharging head 32. Particularly, in this embodiment, the pressure chamber 213 is depressurized after the liquid discharging head 32 has been filled with ink, so it is possible to restrain foreign matter from being drawn from the nozzle N. Furthermore, since the pressure chamber 213 is depressurized after the liquid discharging head 32 has been filled with ink, filling of ink can be speeded up. Furthermore, upon completion of filling of ink, it is possible to efficiently restrain ink from drooping from the nozzle N.

B. Second Embodiment

Figure 11:
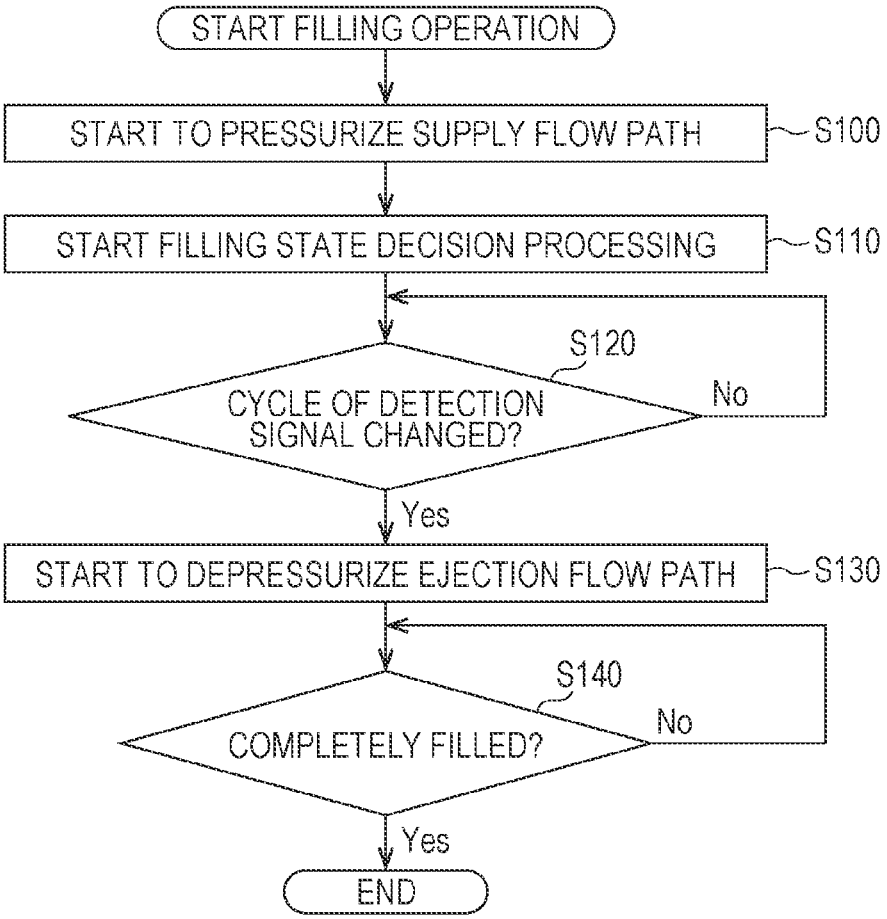
FIG. 11 is a flowchart illustrating a filling operation in a second embodiment.

FIG. 11 is a flowchart illustrating a filling operation in a second embodiment. The structure of the liquid discharging apparatus 100 in the second embodiment is the same as in the first embodiment. In the flowchart illustrated in FIG. 11, the same processing as in the filling operation, illustrated in FIG. 10, in the first embodiment is assigned the same step number.

As illustrated in FIG. 11, processing in steps S100 to S130 in the filling operation in the second embodiment is the same as the filling operation, illustrated in FIG. 10, in the first embodiment. Therefore, detailed descriptions of these steps will be omitted. In the second embodiment, depressurization in the ejection flow path 253 is started by using the depressurizing section 11 in step S130, after which the control section 80 decides in step S140 whether the discharging section D has been completely filled. Specifically, when the cycle of the detection signal SK becomes a cycle corresponding to a cycle in which no bubble is included in the discharging section D, that is, the detection signal SK becomes a cycle in progress when the discharging section D has been fully filled, the control section 80 decides, according to measurement information JS indicating the cycle of the detection signal SK, that the discharging section D has been fully filled.

When the control section 80 does not decide that the discharging section D has been fully filled, the control section 80 repeats decision processing in step S140. When the control section 80 decides that the discharging section D has been fully filled, the control section 80 terminates the filling operation.

According to the second embodiment described so far, after the cycle of the detection signal SK has changed, depressurization in the ejection flow path 253 is started. Then, it is decided according to the detection signal SK whether the liquid discharging head 32 has been fully filled before the filling operation is terminated. Therefore, the liquid discharging head 32 can be more reliably filled with ink.

C. Third Embodiment

Figure 12:
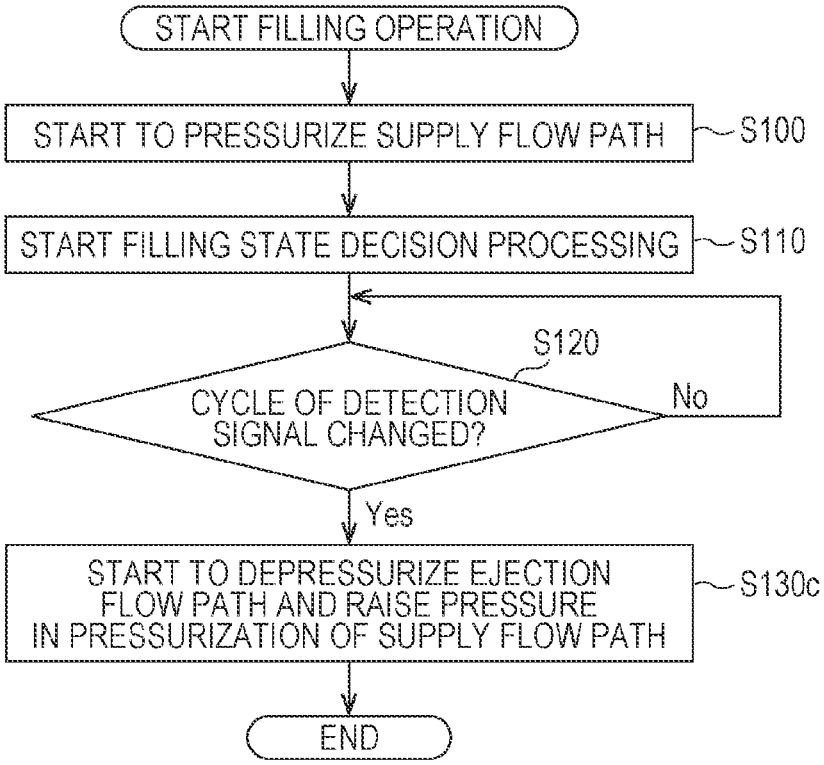
FIG. 12 is a flowchart illustrating a filling operation in a third embodiment.

FIG. 12 is a flowchart illustrating a filling operation in a third embodiment. The structure of the liquid discharging apparatus 100 in the third embodiment is the same as in the first embodiment. In the flowchart illustrated in FIG. 12, the same processing as in the filling operation, illustrated in FIG. 10, in the first embodiment is assigned the same step number.

As illustrated in FIG. 12, processing in steps S100 to S120 in the filling operation in the third embodiment is the same as the filling operation, illustrated in FIG. 10, in the first embodiment. Therefore, detailed descriptions of these steps will be omitted. In the second embodiment, in step S130*c*, the control section 80 starts depressurization in the ejection flow path 253 by using the depressurizing section 11 and causes the pressurizing section 10 to raises pressure in pressurization of the supply flow path 251 before the filling operation is terminated. Pressure in depressurization and pressure in pressurization in step S130*c* have been set so as to be enough to prevent ink from being discharged from the nozzle N due to the difference between these pressures.

According to the third embodiment described so far, after the liquid discharging head 32 has been filled with ink, not only the ejection flow path 253 is depressurized but also pressure in pressurization of the supply flow path 251 is raised concurrently. Therefore, pressure in the liquid discharging head 32 can be stabilized at an earlier time than when only depressurization in the ejection flow path 253 is performed.

D. Fourth Embodiment

Figure 13:
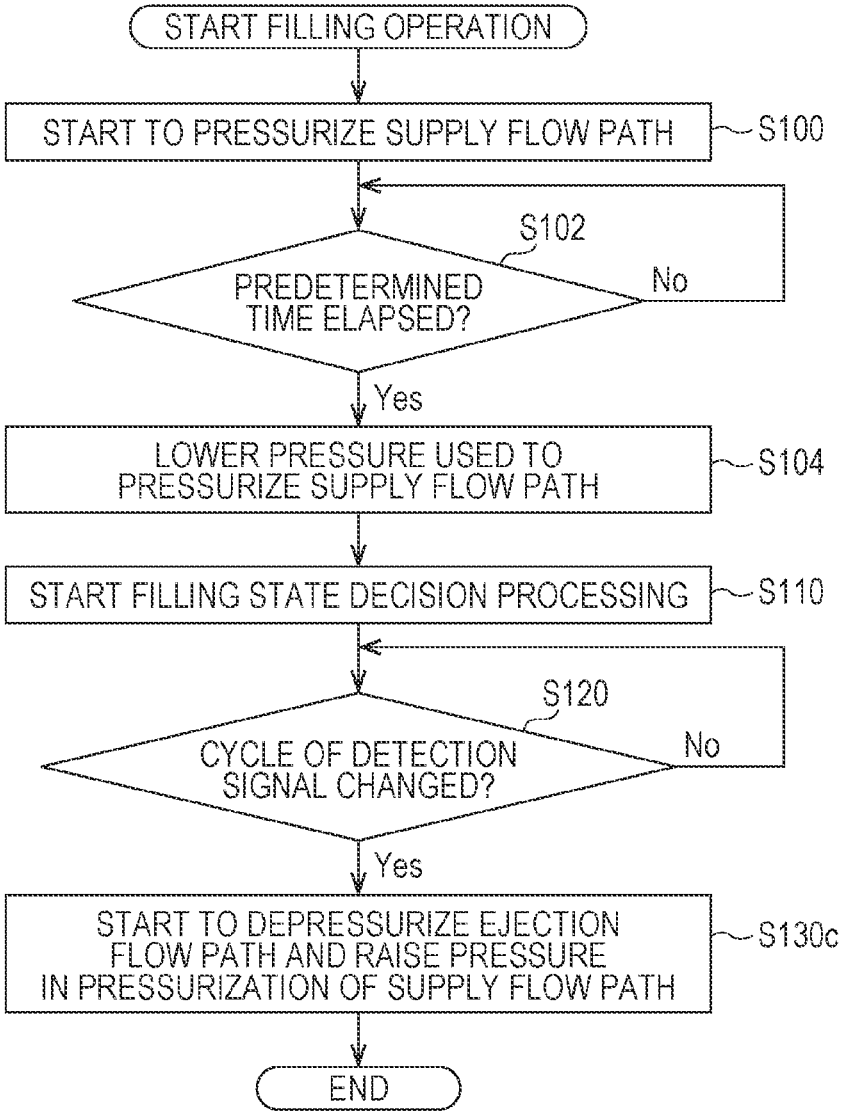
FIG. 13 is a flowchart illustrating a filling operation in a fourth embodiment.

FIG. 13 is a flowchart illustrating a filling operation in a fourth embodiment. The structure of the liquid discharging apparatus 100 in the fourth embodiment is the same as in the first embodiment. In the flowchart illustrated in FIG. 13, the same processing as in the filling operation, illustrated in FIG. 12, in the third embodiment is assigned the same step number.

In the filling operation in the fourth embodiment, after the supply flow path 251 has been pressurized in step S100, it is decided in step S102 whether a predetermined time has elapsed. The predetermined time is determined in advance so as to be shorter than a time taken to complete the filling operation for the discharging section D. When the control section 80 decides that the predetermined time has not elapsed, the control section 80 repeats decision processing in step S102 until the predetermined time elapses. When the control section 80 decides that the predetermined time has elapsed, the control section 80 lowers pressure in step S104, the pressure being applied to pressurize the supply flow path 251, below pressure applied in step S100. In steps S110 to S130*c*, the control section 80 then executes similar processing as in the third embodiment.

According to the fourth embodiment described so far, pressure with which the supply flow path 251 is pressurized is temporarily raised immediately after the filling operation has been started. Therefore, filling of ink into the liquid discharging head 32 can be speeded up.

In step S130*c* in this embodiment, pressure in pressurization by the pressurizing section 10 is raised as in the third embodiment. However, pressure in pressurization may not be raised as in the first and second embodiments.

E. Fifth Embodiment

Figure 14:
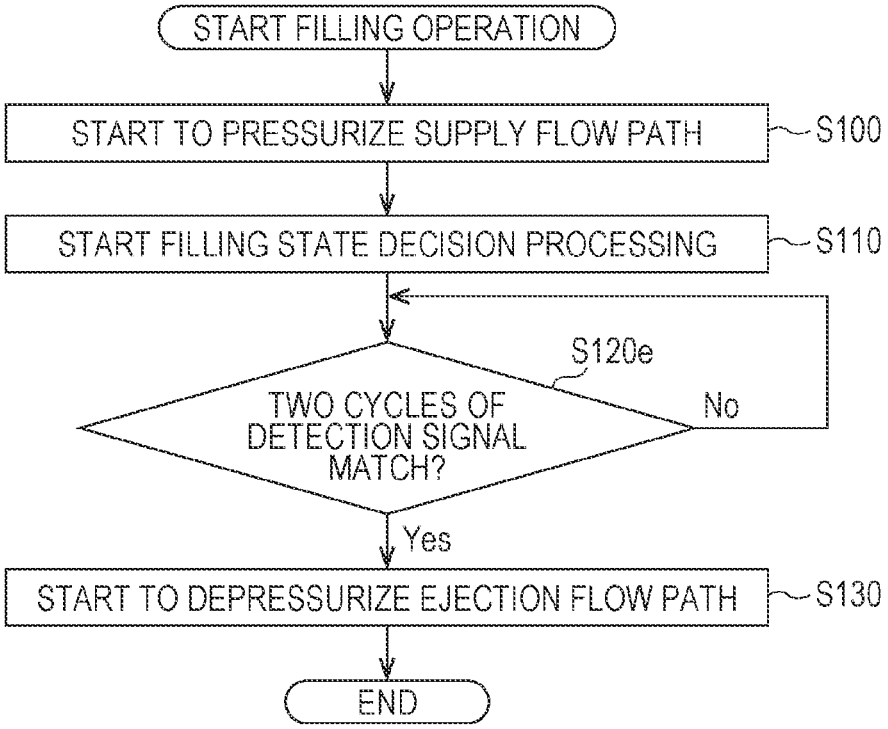
FIG. 14 is a flowchart illustrating a filling operation in a fifth embodiment.

FIG. 14 is a flowchart illustrating a filling operation in a fifth embodiment. In the fifth embodiment, the detection circuit 33 outputs the values of cycles included in the detection signal SK as measurement information JS. Other structures of the liquid discharging apparatus 100 in the fifth embodiment are the same as in the first embodiment. In the flowchart illustrated in FIG. 14, the same processing as in the filling operation, illustrated in FIG. 10, in the first embodiment is assigned the same step number.

In the filling operation in the fifth embodiment, the control section 80 decides whether there is a match between cycle 1 and cycle 2 included in detection signal SK, according to measurement information JS acquired from the detection circuit 33. In this embodiment, cycle 1 is one cycle of residual vibration at a certain time. For example, cycle 1 is a cycle in which a voltage rises from 0, reaches a peak with a positive value, drops, reaches a peak with a negative value, rises again, and reaches 0 (see P1 and P2 in FIG. 9). Cycle 2 is one cycle of residual vibration at a time different from the time in cycle 1. Cycle 2 is preferably a cycle after cycle 1 and is more preferably a cycle immediately after cycle 1. When P1 in FIG. 9 is cycle 1, for example, one cycle immediately after P1 is cycle 2.

Referring again to FIG. 9, it is found that before ink is filled, cycles of residual vibration are different at different times, but after ink has been filled, cycles of residual vibration are almost constant regardless of times. This is because when ink is not filled, a mixture of ink and air is present in the discharging section D, so aerial vibration affects residual vibration of ink as noise, preventing residual vibration from having regular cycles. After ink has been filled, however, the discharging section D is filled with the ink, so cycles of residual vibration are almost unchanged and are regular.

In view of this, in the filling operation in the fifth embodiment, when there is a match between cycle 1 and cycle 2 in step S120*e*, that is, the cycles of residual vibration are regular, the control section 80 decides that the discharging section D has been filled and proceeds to step S130. When there is no match between cycle 1 and cycle 2, that is, the cycles of residual vibration are not regular, the control section 80 decides that the discharging section D has not been filled, in which case the control section 80 executes step S120*e* again. When saying that there is a match between cycle 1 and cycle 2, they do not necessarily have to completely match each other. An approximate match is only necessary between cycle 1 and cycle 2. Here, it will be assumed that cycle 1 is A, for example. Then, when cycle 2 is included in the range indicated by $A \pm A \times 1/10$, it may be decided that there is a match between cycle 1 and cycle 2. Other processing is similar as in the first embodiment.

F. Sixth Embodiment

Figure 15:
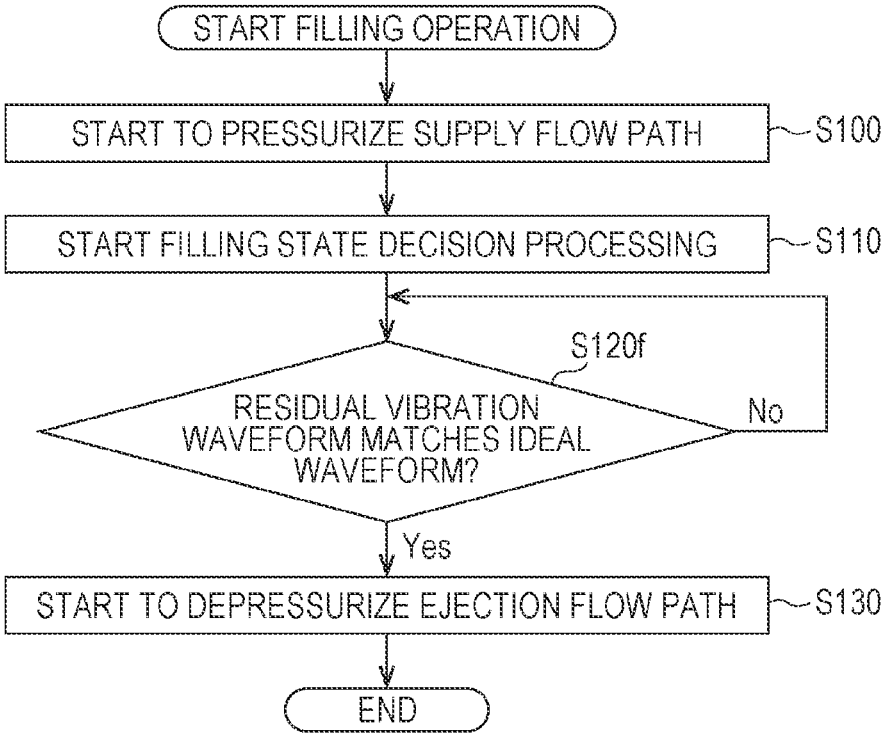
FIG. 15 is a flowchart illustrating a filling operation in a sixth embodiment.

FIG. 15 is a flowchart illustrating a filling operation in a sixth embodiment. In the sixth embodiment, the detection circuit 33 outputs the detection signal SK without alteration, as measurement information JS. Other structures of the liquid discharging apparatus 100 in the sixth embodiment are the same as in the first embodiment. In the flowchart illustrated in FIG. 15, the same processing as in the filling operation, illustrated in FIG. 10, in the first embodiment is assigned the same step number.

In the filling operation in the sixth embodiment, in step S120*f*, the control section 80 compares the waveform itself of residual vibration, the waveform being obtained according to the detection signal SK acquired from the detection circuit 33, with an ideal waveform of residual vibration, the ideal waveform being assumed to be formed during ink filling and being stored in a storage circuit in advance. The control section 80 then decides whether the obtained residual vibration waveform matches the stored ideal waveform. When saying that the residual vibration waveform matches the ideal waveform, the residual vibration waveform does not necessarily have to completely match the ideal waveform. The residual vibration waveform only needs to approximately match the ideal waveform. When, for example, parameters, such as voltage, of these waveforms match at various times within a range of 10%, it may be determined that the residual vibration waveform approximately matches the ideal waveform. When the residual vibration waveform matches the ideal waveform, the control section 80 proceeds to step S130. When the residual vibration waveform does not match the ideal waveform, the control section 80 executes step S120*f* again. Other processing is similar as in the first embodiment.

G. Seventh Embodiment

Figure 16:
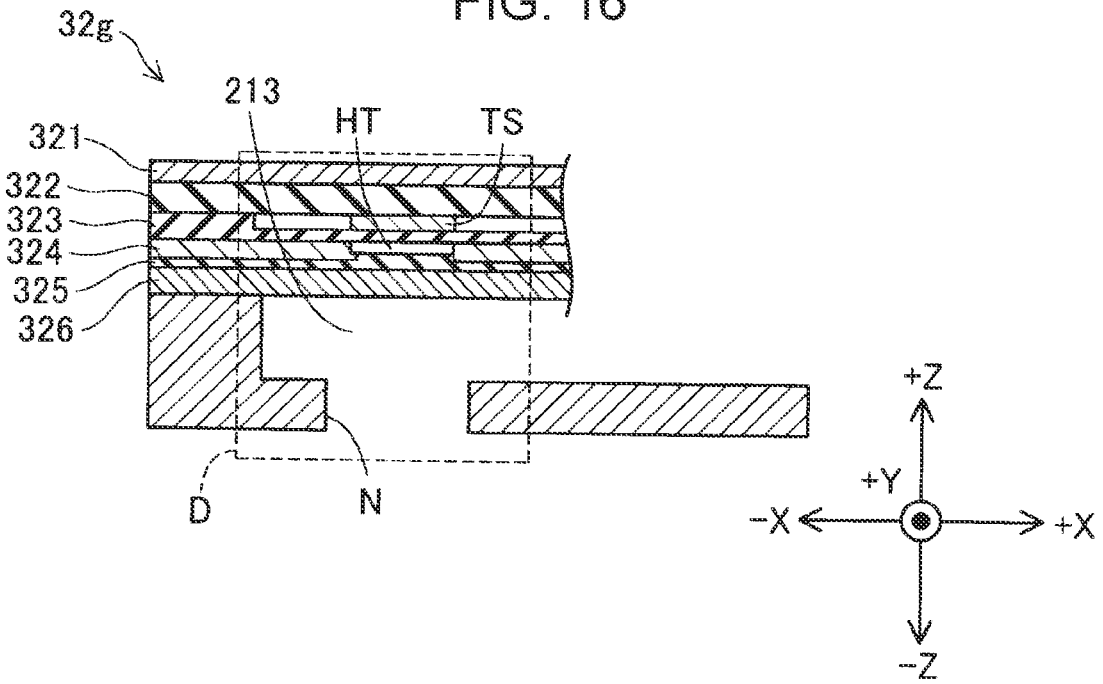
FIG. 16 is a sectional view illustrating the main parts of a liquid discharging head in a seventh embodiment.

FIG. 16 is a sectional view illustrating the main parts of a liquid discharging head 32*g* in a seventh embodiment. Although the liquid discharging head 32 in the first embodiment has the piezoelectric element PZ as a driving element, the liquid discharging head 32*g* in the seventh embodiment has a heater HT as a driving element. In the pressure chamber 213, the heater HT is disposed at a position at which the heater HT faces the nozzle N. The liquid discharging head 32*g* in the seventh embodiment further has a temperature sensor TS. The detection circuit 33 detects a signal related to temperature in the pressure chamber 213 by using the temperature sensor TS. In FIG. 16, the structure on the same side as the ejection flow path 253 positioned downstream of the pressure chamber 213 is omitted.

The liquid discharging head 32*g* has a silicon (Si) substrate 321 at a position at which the Si substrate 321 faces the nozzle N. The temperature sensor TS, which is formed from a thin-film resistive element made of aluminum (Al), platinum (Pt), titanium (Ti) or the like, is disposed on the −Z-direction side of the Si substrate 321, with a heat storage layer 322, formed from a thermally-oxidized film (silicon dioxide ($SiO_2$)) or the like, intervening between the Si substrate 321 and the temperature sensor TS. In addition, a wire 324 coupled to the heater HT and driving circuit 31, a passivation layer 325 made of silicon nitride (SiN) or the like, and a cavitation-resistant film 326 made of tantalum (Ta) or the like are laminated on the −Z-direction of the Si substrate 321, with an inter-layer insulating film 323 intervening between the Si substrate 321 and these laminated elements.

When ink is to be discharged or it is checked whether ink is filled, the driving circuit 31 in this embodiment supplies a single rectangular wave to the heater HT in a unit period TP. Then, ink in the discharging section D is heated by the heater HT, generating a bubble immediately below the 1 cavitation-resistant film 326. When the bubble grows, ink is pushed out of the nozzle N.

Figure 17:
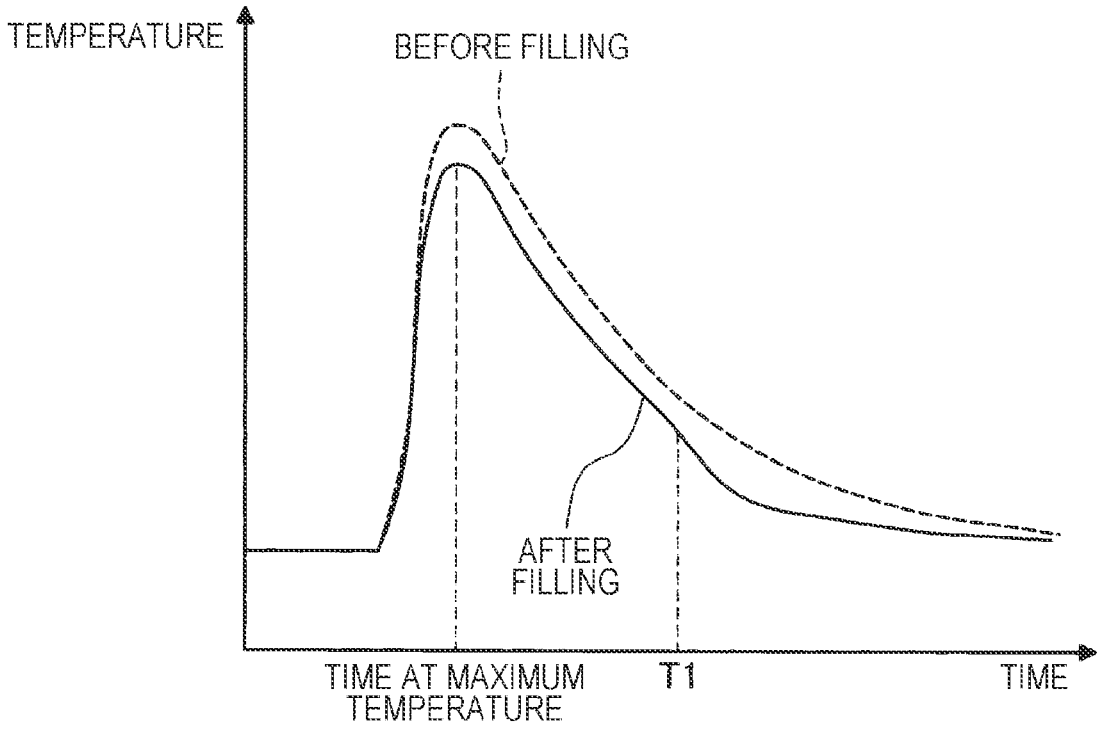
FIG. 17 is a graph illustrating changes in temperature in a discharging section.

FIG. 17 is a graph illustrating changes, detected by the temperature sensor TS, in temperature in the pressure chamber 213. When the discharging section D is filled with ink, temperature falling is rapidly speeded up at time T1 at which a certain time has elapsed from a time at which temperature detected by the temperature sensor TS reached the maximum temperature, as indicated by the solid line in FIG. 17. This is because when the bubble contacts after it has grown, ink and the cavitation-resistant film 326 come into mutual contact again and cooling of the heater HT proceeds. When the discharging section D is not filled with ink and heat is not thereby transmitted from the heater HT to ink, a rapid change does not occur in the inclination in the temperature falling process, as indicated by the dashed line in FIG. 17. Therefore, the control section 80 can acquire a signal related to temperature measured by the temperature sensor TS from the detection circuit 33, and can decide whether the discharging section D has been filled depending on whether there is a time in a unit period TP at which the temperature falling is rapidly speeded up.

Figure 18:
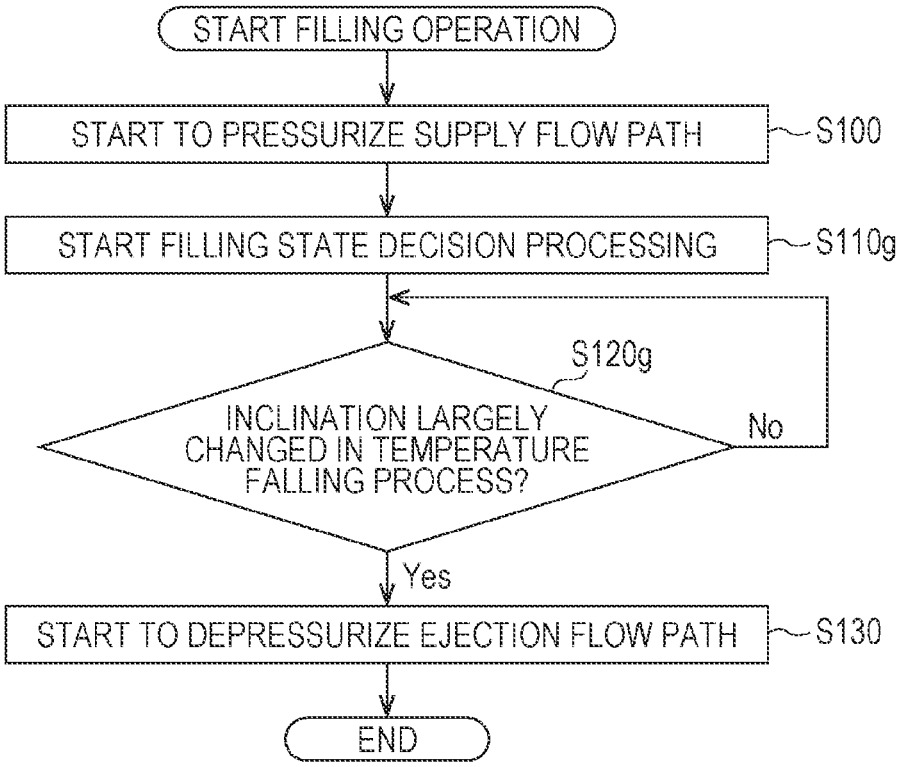
FIG. 18 is a flowchart illustrating a filling operation in the seventh embodiment.

FIG. 18 is a flowchart illustrating a filling operation in a seventh embodiment. In the flowchart in FIG. 18, the same processing as in the filling operation, illustrated in FIG. 10, in the first embodiment is assigned the same step number. In step S100, the control section 80 first starts to supply ink from the liquid storage section 14 into the discharging section D by using the pressurizing section 10 to pressurize the supply flow path 251.

Upon starting to supply ink, the control section 80 starts filling state decision processing in step S110*g*. In filling state decision processing in this embodiment, the control section 80 supplies a single rectangular wave to the heater HT for each unit period TP by using the driving circuit 31. The amplitude of this rectangular wave has been set so as to be enough to prevent ink from being discharged from the nozzle N. In addition, the control section 80 acquires temperature, measured by the temperature sensor TS, of the discharging section D by using the detection circuit 33.

In step S120*g*, the control section 80 decides whether a time at which the inclination largely changed has appeared within a predetermined period in the temperature falling process for temperature change in the discharging section D. To set the predetermined period, a time taken until the inclination in temperature change largely changes is obtained in advance in a measurement or experiment in a state in which the discharging section D is normally filled with ink.

In step S120*g*, when the control section 80 decides that a time at which the inclination largely changes has not appeared within the predetermined period, the control section 80 decides that the discharging section D is not filled, in which case the control section 80 executes step S120*g* again and continues to execute filling state decision processing.

In step S120*g*, when the control section 80 decides that a time at which the inclination largely changes has appeared within the predetermined period, the control section 80 determines that the discharging section D is filled. The control section 80 then controls the depressurizing section 11 to start depressurization in the ejection flow path 253 in step S130, and terminates the filling operation.

Even when the heater HT is used as a driving element that causes ink to be discharged is used as in the seventh embodiment described above, the liquid discharging head 32*g* can be filled with ink without excess or deficiency, as in the first embodiment.

In this embodiment, the temperature sensor TS is disposed immediately above the heater HT with the inter-layer insulating film 323 intervening between the heater HT and the temperature sensor TS. When the discharging section D is not filled with ink, therefore, heat is not transmitted from the heater HT to ink, so temperature measured by the temperature sensor TS is high. However, when the discharging section D is filled with ink, heat is transmitted to the ink, so temperature measured by the temperature sensor TS is low. In step S120*g* described above, therefore, whether the discharging section D has been filled with ink can also be decided by detecting that the maximum temperature measured by the temperature sensor TS has changed from high to low.

In the seventh embodiment, only processing in steps S110*g* and S120*g* illustrated in FIG. 18 respectively differ from processing in steps S110 and S120 in the first to fourth embodiments. In steps other than steps S110*g* and S120*g*, processing similar to processing in the first to fourth embodiment can be applied.

In the seventh embodiment, the temperature sensor TS is placed in the vicinity of the heater HT. However, when a different temperature change can be detected depending on whether the pressure chamber 213 is filled with ink, the temperature sensor TS may be placed at a distance from the heater HT.

H. Other Embodiments

H-1. The liquid discharging apparatus 100 in the above embodiments has the depressurizing section 11 and ejection flow path 253. Instead of this, the liquid discharging apparatus 100 may have neither the depressurizing section 11 nor the ejection flow path 253. That is, the liquid discharging apparatus 100 may be such that ink is not circulated. In this case, the filling operations described in the above embodiments are terminated without the ejection flow path 253 being depressurized.

H-2. The liquid discharging apparatus 100 in the above embodiments has the pressurizing section 10. Instead of this, the liquid discharging apparatus 100 may not have the pressurizing section 10. In this case, the liquid discharging apparatus 100 may supply ink from the liquid storage section 14 to the liquid discharging head 32 by using the difference in hydraulic head between the liquid discharging head 32 and the liquid storage section 14.

H-3. In the liquid discharging apparatus 100 in the above embodiments, ink ejected from the ejection flow path 253 is collected into the liquid storage section 14 to circulate the ink. Instead of this, the liquid discharging apparatus 100 may be such that ink ejected from the ejection flow path 253 is not collected.

H-4. In the filling operations described in the above embodiments, after the liquid discharging head 32 has been filled with ink, the ejection flow path 253 is depressurized. Instead of this, immediately after the start of the filling operation, the control section 80 may start to depressurize the ejection flow path 253 concurrently with pressurizing the supply flow path 251. However, pressure in depressurization is set so as to be enough to supply ink to the discharging section D.

H-5. In the above first to fourth embodiments, a single piezoelectric element PZ doubles as the element that applies vibration to the pressure chamber 213 and the element that detects residual vibration. Instead of this, the element that applies vibration to the pressure chamber 213 and the element that detects residual vibration may be different elements placed at different positions.

I. Other Aspects

The present disclosure is not limited to the above embodiments. The present disclosure can be implemented with various other structures, without departing from the intended scope of the present disclosure. For example, technical features, in the above embodiments, corresponding to technical features in the aspects described below can be appropriately replaced or combined to solve part or all of the problems described above or achieve part or all of the effects described above. When these technical features are not described in this specification as being essential, the technical features can be appropriately deleted.

1. According to a first aspect of the present disclosure, a liquid discharging apparatus is provided. This liquid discharging apparatus has: a liquid discharging head that has a driving element and a pressure chamber in which liquid is pressurized when the driving element is driven; a driving circuit that drives the driving element; a detection circuit that detects a signal related to residual vibration in the pressure chamber; and a control section that controls a filling operation to supply liquid from the outside into the liquid discharging head. The control section terminates the filling operation according to a signal detected by the detection circuit after the driving element is driven by the driving circuit.

According to this aspect, the filling operation is terminated according to a signal detected by the detection circuit after the driving element is driven by the driving circuit. Therefore, the liquid discharging head can be filled with liquid without excess or deficiency 2. According to a second aspect of the present disclosure, a liquid discharging apparatus is provided. This liquid discharging apparatus has: a liquid discharging head that has a driving element and a pressure chamber in which liquid is pressurized when the driving element is driven; a driving circuit that drives the driving element; a detection circuit that detects a signal related to temperature in the pressure chamber; and a control section that controls a filling operation to supply liquid from the outside into the liquid discharging head. The control section terminates the filling operation according to a signal detected by the detection circuit after the driving element is driven by the driving circuit.

According to this aspect, the filling operation is terminated according to a signal detected by the detection circuit after the driving element is driven by the driving circuit. Therefore, the liquid discharging head can be filled with liquid without excess or deficiency 3. In the above aspects, the liquid discharging apparatus may further have: a supply flow path through which liquid is supplied to the pressure chamber; and a pressurizing section that pressurizes the supply flow path. The control section may cause the pressurizing section to perform pressurization in the filling operation. In this aspect, the pressurizing section can be used to efficiently fill liquid.

4. In the above aspects, the liquid discharging apparatus may further have: an ejection flow path through which liquid is ejected from the pressure chamber; and a depressurizing section that depressurizes the ejection flow path. The control section may cause the depressurizing section to perform depressurization in the filling operation. In this aspect, it is possible to fill the liquid discharging head with liquid while the pressure chamber is being depressurized.

5. In the above aspects, the control section may cause the pressurizing section to start pressurization, and after the start of the pressurization, may terminate the filling operation according to a signal detected by the detection circuit after the driving element is driven by the driving circuit. In this aspect, liquid can be efficiently filled.

6. In the above aspects, the control section: may cause the pressurizing section to start pressurization; after the start of the pressurization, may cause the depressurizing section to start depressurization according to a signal detected by the detection circuit after the driving element is driven by the driving circuit; and after the start of the depressurization, may terminate the filling operation. In this aspect, the depressurizing section can be used to restrain liquid from leaking from the liquid discharging head.

7. In the above aspects, the control section: may cause the pressurizing section to start pressurization; after the start of the pressurization, may cause the depressurizing section to start depressurization according to a signal detected by the detection circuit after the driving element is driven by the driving circuit; and after the start of the depressurization, may terminate the filling operation according to a signal detected by the detection circuit after the driving element is driven by the driving circuit. In this aspect, since the filling operation is terminated according to a signal detected by the detection circuit after depressurization, liquid can be more reliably filled.

8. In the above aspects, the control section: may cause the pressurizing section to start pressurization; after the start of the pressurization, may cause the depressurizing section to start depressurization and raise pressure in the pressurization by the pressurizing section, according to a signal detected by the detection circuit after the driving element is driven by the driving circuit; and after a rise in pressure in the pressurization, may terminate the filling operation. In this aspect, after the start of depressurization, pressure in the pressure chamber can be stabilized at an early time.

9. In the above aspects, the control section: may cause the pressurizing section to start pressurization; after the start of the pressurization, may reduce pressure in the pressurization by the pressurizing section; after a reduction in pressure in the pressurization, may cause the depressurizing section to start depressurization and may cause by the pressurizing section to raise pressure in the pressurization, according to a signal detected by the detection circuit after the driving element is driven by the driving circuit; and after a rise in pressure in the pressurization, may terminate the filling operation. In this aspect, since pressure in pressurization can be raised immediately after the start of filling, the filling of liquid can be speeded up.

10. In the above aspects, the control section may alternately cause the driving of the driving element by the driving circuit and the detection of the signal by the detection circuit. In this aspect, precision in the detection of the signal can be raised.

11. In the above aspects, when a change occurs in the signal detected by the detection circuit, the control section may terminate the filling operation. In this aspect, it can be precisely detected that the liquid discharging head has been filled with liquid.

12. In the above aspects, after the driving element is driven by the driving circuit, when the cycle of residual vibration, the cycle being indicated by the signal detected by the detection circuit, changes to a cycle longer than the cycle of residual vibration so far, the control section may terminate the filling operation. In this aspect, it can be precisely detected that the liquid discharging head has been filled with liquid.

13. In the above aspects, after the driving element is driven by the driving circuit, when a match occurs between the cycle of residual vibration at a time, the cycle being indicated by the signal detected by the detection circuit, and the cycle of residual vibration at another time, the control section may terminate the filling operation.

14. In the above aspects, after the driving element is driven by the driving circuit, when a match occurs between the waveform of residual vibration, the waveform being indicated by the signal detected by the detection circuit, and a prestored ideal residual vibration waveform taken while the filling operation is terminated, the control section may terminate the filling operation.

15. According to a third aspect of the present disclosure, a liquid filling method is provided, the method being executed by a liquid discharging apparatus that has: a liquid discharging head that has a driving element and a pressure chamber in which liquid is pressurized when the driving element is driven; a driving circuit that drives the driving element; and a detection circuit that detects a signal related to residual vibration in the pressure chamber. In this liquid filling method, after a filling operation to supply liquid from the outside into the liquid discharging head is started, the filling operation is terminated according to a signal detected by the detection circuit after the driving element is driven by the driving circuit.

16. According to a fourth aspect of the present disclosure, a liquid filling method is provided, the method being executed by a liquid discharging apparatus that has: a liquid discharging head that has a driving element and a pressure chamber in which liquid is pressurized when the driving element is driven; a driving circuit that drives the driving element; and a detection circuit that detects a signal related to temperature in the pressure chamber. In this liquid filling method, after a filling operation to supply liquid from the outside into the liquid discharging head is started, the filling operation is terminated according to a signal detected by the detection circuit after the driving element is driven by the driving circuit.

What is claimed is:

1. A liquid discharging apparatus comprising:

a liquid discharging head that has a driving element and a pressure chamber in which liquid is pressurized when the driving element is driven;

a driving circuit that drives the driving element;

a detection circuit that detects a signal related to residual vibration in the pressure chamber; and a control section that controls a filling operation to supply liquid from an outside into the liquid discharging head;

wherein the control section terminates the filling operation according to a signal detected by the detection circuit after the driving element is driven by the driving circuit.

2. The liquid discharging apparatus according to claim 1, further comprising:

a supply flow path through which liquid is supplied to the pressure chamber; and a pressurizing section that pressurizes the supply flow path; wherein the control section causes the pressurizing section to perform pressurization in the filling operation.

3. The liquid discharging apparatus according to claim 2, further comprising:

an ejection flow path through which liquid is ejected from the pressure chamber; and a depressurizing section that depressurizes the ejection flow path; wherein the control section causes the depressurizing section to perform depressurization in the filling operation.

4. The liquid discharging apparatus according to claim 3, wherein the control section causes the pressurizing section to start pressurization, after a start of the pressurization, causes the depressurizing section to start depressurization according to a signal detected by the detection circuit after the driving element is driven by the driving circuit, and after a start of the depressurization, terminates the filling operation.

5. The liquid discharging apparatus according to claim 3, wherein the control section causes the pressurizing section to start pressurization, after a start of the pressurization, causes the depressurizing section to start depressurization according to a signal detected by the detection circuit after the driving element is driven by the driving circuit, and after a start of the depressurization, terminates the filling operation according to a signal detected by the detection circuit after the driving element is driven by the driving circuit.

6. The liquid discharging apparatus according to claim 3, wherein the control section causes the pressurizing section to start pressurization, after a start of the pressurization, causes the depressurizing section to start depressurization and raises pressure in the pressurization by the pressurizing section, according to a signal detected by the detection circuit after the driving element is driven by the driving circuit, and after a rise in pressure in the pressurization, terminates the filling operation.

7. The liquid discharging apparatus according to claim 3, wherein the control section causes the pressurizing section to start pressurization, after a start of the pressurization, reduces pressure in the pressurization by the pressurizing section, after a reduction in pressure in the pressurization, causes the depressurizing section to start depressurization and causes the pressurizing section to raise pressure in the pressurization, according to a signal detected by the detection circuit after the driving element is driven by the driving circuit, and after a rise in the pressure in the pressurization, terminates the filling operation.

8. The liquid discharging apparatus according to claim 2, wherein the control section causes the pressurizing section to start pressurization, and after a start of the pressurization, terminates the filling operation according to a signal detected by the detection circuit after the driving element is driven by the driving circuit.

9. The liquid discharging apparatus according to claim 1, wherein the control section alternately causes driving of the driving element by the driving circuit and detection of the signal by the detection circuit.

10. The liquid discharging apparatus according to claim 9, wherein after the driving element is driven by the driving circuit, when a cycle of residual vibration, the cycle being indicated by the signal detected by the detection circuit, changes to a cycle longer than a cycle of residual vibration so far, the control section terminates the filling operation.

11. The liquid discharging apparatus according to claim 9, wherein after the driving element is driven by the driving circuit, when a match occurs between a cycle of residual vibration at a time, the cycle being indicated by the signal detected by the detection circuit, and a cycle of residual vibration at another time, the control section terminates the filling operation.

12. The liquid discharging apparatus according to claim 9, wherein after the driving element is driven by the driving circuit, when a match occurs between a waveform of residual vibration, the waveform being indicated by the signal detected by the detection circuit, and a prestored ideal residual vibration waveform taken while the filling operation is terminated, the control section terminates the filling operation.

13. The liquid discharging apparatus according to claim 1, wherein when a change occurs in the signal detected by the detection circuit, the control section terminates the filling operation.

14. A liquid discharging apparatus comprising:

a liquid discharging head that has a driving element and a pressure chamber in which liquid is pressurized when the driving element is driven;

a driving circuit that drives the driving element;

a detection circuit that detects a signal related to temperature in the pressure chamber; and a control section that controls a filling operation to supply liquid from an outside into the liquid discharging head;

wherein the control section terminates the filling operation according to a signal detected by the detection circuit after the driving element is driven by the driving circuit.

15. A liquid filling method executed by a liquid discharging apparatus that has:

a liquid discharging head that has a driving element and a pressure chamber in which liquid is pressurized when the driving element is driven;

a driving circuit that drives the driving element; and a detection circuit that detects a signal related to residual vibration in the pressure chamber; the method comprising terminating, after a filling operation to supply liquid from an outside into the liquid discharging head is started, the filling operation according to a signal detected by the detection circuit after the driving element is driven by the driving circuit.

16. A liquid filling method executed by a liquid discharging apparatus that has:

a liquid discharging head that has a driving element and a pressure chamber in which liquid is pressurized when the driving element is driven;

a driving circuit that drives the driving element; and a detection circuit that detects a signal related to temperature in the pressure chamber; the method comprising terminating, after a filling operation to supply liquid from an outside into the liquid discharging head is started, the filling operation according to a signal detected by the detection circuit after the driving element is driven by the driving circuit.

* * * * *